US007738817B2

(12) United States Patent
Sasae et al.

(10) Patent No.: US 7,738,817 B2
(45) Date of Patent: Jun. 15, 2010

(54) DEVELOPER SUPPLY CONTAINER AND IMAGE FORMING APPARATUS

(75) Inventors: Kazuyoshi Sasae, Toride (JP); Nobuo Nakajima, Higashimatsuyama (JP); Fumio Tazawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 11/718,473

(22) PCT Filed: Nov. 10, 2005

(86) PCT No.: PCT/JP2005/021066

§ 371 (c)(1),
(2), (4) Date: Jan. 29, 2008

(87) PCT Pub. No.: WO2006/052005

PCT Pub. Date: May 18, 2006

(65) Prior Publication Data

US 2008/0260422 A1 Oct. 23, 2008

(30) Foreign Application Priority Data

Nov. 12, 2004 (JP) ..... 2004-328680

(51) Int. Cl.
*G03G 15/08* (2006.01)

(52) U.S. Cl. ..... 399/258; 399/119; 399/262

(58) Field of Classification Search ..... 399/258, 399/262, 119, 120
See application file for complete search history.

(56) References Cited

U.S. PATENT DOCUMENTS 5,331,390 A 7/1994 Kimura et al. ..... 399/227
6,289,193 B1 9/2001 Ban et al. ..... 399/258
6,292,644 B1 9/2001 Goto et al. ..... 399/262
6,314,261 B1 11/2001 Omata et al. ..... 399/258

(Continued)

FOREIGN PATENT DOCUMENTS

CN 1144099 C 3/2004

(Continued)

OTHER PUBLICATIONS

Chinese Office Action issued on May 23, 2008 in Chinese Application No. 200580038584.0, with English-language translation.

*Primary Examiner*—Sophia S Chen
(74) *Attorney, Agent, or Firm*—Fitzpatrick, Cella, Harper & Scinto

(57) ABSTRACT

A developer supply container detachably mountable to a main assembly of an image forming apparatus includes a developer containing portion; a developer discharge opening disposed at the developer containing portion; a container side engaging portion engageable with a main assembly side engaging portion; an operation member; and a transmitting portion in the operation member for transmitting a driving force to a relay portion in the main assembly for opening and closing the developer discharge opening. In a container mounted state, the operation member is capable of opening and closing a main assembly shutter member for opening and closing the developer discharge opening through the relay portion. The container side engaging portion engages with the main assembly side engaging portion when the operation member is moved in a opening direction for opening the main assembly shutter member and releases the engagement when moved in a closing direction for closing the main assembly shutter member.

12 Claims, 16 Drawing Sheets

U.S. PATENT DOCUMENTS

| | | | | |
|---|---|---|---|---|
| 6,438,345 | B1 | 8/2002 | Ban et al. | 399/262 |
| 6,766,133 | B1 | 7/2004 | Ban et al. | 399/258 |
| 6,879,789 | B2 | 4/2005 | Yamada et al. | 399/106 |
| 6,920,298 | B2 | 7/2005 | Yamada et al. | 399/106 |
| 6,944,417 | B2 | 9/2005 | Yamada et al. | 399/263 |
| 6,947,690 | B2 | 9/2005 | Tazawa et al. | 399/258 |
| 6,990,301 | B2 | 1/2006 | Yamada et al. | 399/106 |
| 7,039,347 | B2 | 5/2006 | Yamada et al. | 399/263 |
| 7,079,788 | B2 | 7/2006 | Ban et al. | 399/120 |
| 7,127,193 | B2 | 10/2006 | Yamada et al. | 399/106 |
| 7,203,449 | B2 | 4/2007 | Ban et al. | 399/258 |
| 7,266,330 | B2 | 9/2007 | Murakami et al. | 399/262 |
| 7,292,811 | B2 | 11/2007 | Ban et al. | 399/258 |
| 2004/0161266 | A1 | 8/2004 | Ban et al. | 399/258 |
| 2005/0047818 | A1 | 3/2005 | Yamada et al. | 399/106 |
| 2005/0135841 | A1* | 6/2005 | Murakami et al. | 399/258 |
| 2006/0008290 | A1 | 1/2006 | Yamada et al. | 399/106 |
| 2006/0008291 | A1 | 1/2006 | Yamada et al. | 399/106 |
| 2006/0051107 | A1 | 3/2006 | Fujiwara et al. | 399/12 |
| 2006/0104671 | A1 | 5/2006 | Murakami et al. | 399/258 |
| 2006/0104673 | A1 | 5/2006 | Sasae et al. | 399/262 |
| 2007/0086810 | A1 | 4/2007 | Yamada et al. | 399/258 |
| 2007/0092304 | A1 | 4/2007 | Yamada et al. | 399/258 |
| 2007/0098454 | A1 | 5/2007 | Yamada et al. | 399/258 |
| 2007/0231016 | A1 | 10/2007 | Ban et al. | 399/258 |

FOREIGN PATENT DOCUMENTS

| | | | |
|---|---|---|---|
| EP | 0 989 472 | A2 | 3/2000 |
| EP | 1 437 632 | A1 | 7/2004 |
| JP | 53-46040 | | 4/1978 |
| JP | 5-307322 | | 11/1993 |
| JP | 2000-162861 | | 6/2000 |
| JP | 2003-107892 | A1 * | 4/2003 |

* cited by examiner (a)

(b)

DEVELOPER SUPPLY CONTAINER AND IMAGE FORMING APPARATUS

TECHNICAL FIELD

The present invention relates to a developer supply container for supplying a powdery developer to an electrophotographic image forming apparatus for forming an image with the developer, and the image forming apparatus using the developer supply container.

BACKGROUND ART

The electrophotographic image forming apparatus is an image forming apparatus for forming an image on a recording medium in accordance with an electrophotographic image forming method. Examples of the electrophotographic image forming apparatus may include an electrophotographic copying machine, electrophotographic printers (such as a laser beam printer and an LED printer), a facsimile apparatus, a word processor, etc.

In the image forming apparatus such as the electrophotographic copying machine, the laser beam printer, etc., a latent image is formed by selectively exposing an electrically uniformly charged surface of a photosensitive drum to light and is developed with a developer to form a developer image. Then, the developer image is transferred onto a recording medium to effect image recording. In such an image forming apparatus, the developer is required to be supplied every time the developer is used up. Here, a developer supply container for supplying the developer to the image forming apparatus is roughly classified into a so-called simultaneous supply-type developer supply container which supply the whole amount of developer contained in the developer supply container to a developer receiving container of a main assembly of the image forming apparatus at the same time and a stationary-type developer supply container which is mounted into the image forming apparatus main assembly, left standing as it is, and gradually supplies the developer to a developing apparatus until the developer is used up.

Particularly, in recent years, from the viewpoints of contamination during supply of the developer and operability, many proposals for the latter stationary-type developer supply container have been made. In the case where a developer in an image forming apparatus is consumed, a developer supply container (hereinafter also referred to as a "toner cartridge") is replaced by demounting it from the image forming apparatus and mounting a new one into the image forming apparatus, so that (fresh) toner is supplied to the image forming apparatus.

The toner as the developer is very fine powder, so that there has arisen such a problem that the toner scatters from a minute spacing between constitutional parts due to operational vibrations or the like during a toner supply operation, thus contaminating a user or surrounding parts with the toner. For this reason, such a method that a developer supply container is mounted inside a main assembly of image forming apparatus and toner is discharged little by little from a small opening has been proposed and put into practical use. In such a method, it is difficult to discharge the toner naturally by the action of gravity or the like, so that the image forming apparatus is generally provided with any toner stirring conveyance means.

Further, below the toner cartridge (developer supply container), the image forming apparatus is provided with a buffer portion, as a toner containing portion, for temporarily storing the toner. Inside the buffer portion, a metering screw for stirring the toner and feeding a predetermined amount of toner corresponding to a degree of rotation and a conveyance screw, disposed downstream from the metering screw, for conveying the toner by being rotated always during recording (image formation) are disposed so as to supply a necessary amount of toner to a process cartridge.

In the case where all the amounts of toner in the toner cartridge are discharged into the buffer portion to empty the toner cartridge in the above described image forming apparatus, the image forming apparatus detects the empty of the toner cartridge and provides notification, to a user, that the developer supply container should be replaced with new one. In accordance with this notification, the user removes the (old) empty developer supply container from the image forming apparatus and inserts a new developer supply container into the image forming apparatus in place of the empty developer supply container, so that the image forming apparatus is capable of further continuing an image forming operation.

Japanese Laid-Open Patent Application No. 2000-162861 has disclosed, as an example of a conventional developer supply container, such a constitution that a shutter of a developer supply container is opened and closed through a rotational force transmission member provided in a main assembly of an image forming apparatus, as shown in FIGS. 13 and 14.

Referring to FIG. 13, an image forming apparatus is provided with an open/close portion 501 at a side surface of an main assembly 500 of the image forming apparatus, so that a developer supply container (toner cartridge) 600 is mounted and demounted from the side surface of the image forming, apparatus. The toner cartridge 600 has, as shown in FIG. 14(*a*), a developer discharge opening 601 (FIG. 15) sealed or covered with a container shutter 602. The container shutter 602 is constituted so that it is not readily opened even when a user rotationally moves it in a simple one direction outside the main assembly, thus preventing toner from contaminating surrounding parts or portions due to erroneous leakage.

Further, as shown in FIG. 14(*b*), when the toner cartridge 600 is mounted into the main assembly 500 of the image forming apparatus, a driving force is transmitted from a driving force transmission portion 603*a* of a knob 603 provided to the toner cartridge 600 to a driving force receiving portion 602*a* of the container shutter 602 through a driving force relay portion 502 provided in the apparatus main assembly by rotationally driving the knob 603 of the toner cartridge 600, so that the container shutter 602 is moved apart from a toner discharge opening. Incidentally, in FIGS. 14(*a*) and 14(*b*), the toner cartridge 600 is depicted upside down for convenience of explanation. Accordingly, during actual mounting of the toner cartridge 600, an upper surface of the toner cartridge 600 shown in these figures is located at a lower surface thereof in the actual mounted state.

Further, as shown in FIG. 15, a buffer portion 503 of the apparatus main assembly 500 is provided with a developer receiving opening 504 opposite an apparatus shutter 505 for preventing contamination when the toner cartridge 600 is not mounted. The container shutter 602 and the apparatus shutter 505 are engaged with each other by mounting the toner cartridge 600 into the main assembly 500 to perform an open/close operation in an integrated state. Accordingly, by rotating the knob 603, the container shutter 602 and the main assembly shutter 505 can be opened simultaneously to cause the toner container 600 and the buffer portion 503 to communicate with each other to create a toner suppliable state. Further, when the toner container 600 is demounted from the apparatus main assembly 500, the toner container 600 is pulled out after the container shutter 602 and the main assembly shutter 505 are closed by rotating the knob 603. When the toner container 600 is capable of being demounted in such a state that the main assembly shutter 505 is not completely closed, the developer receiving opening 504 is placed in an incomplete closing state, so that contaminant or the like enters the buffer portion. As a result, there is a possibility that a photosensitive drum is damaged, to adversely affecting an image.

In the constitution as described above, as a driving force transmission mechanism, gears are ordinarily used. For this reason, an idling period is generated by the time rotation members start to transmit a driving force to each other when the container shutter is rotated by the knob from the opened state toward a closing direction. This is because there is backlash between the gears. More specifically, with reference to FIGS. 16(*a*) to 16(*c*), when the knob 603 is rotated, a gear of the driving force transmission receiving portion 603*a* (having teeth K, L) is rotated in a direction of an arrow E to rotate a gear of the driving force relay portion 502 (having teeth M, N) in a direction of an arrow G. As a result, when the container shutter 602 is opened, as shown in FIG. 16(*a*), tooth K and tooth M are stopped in a contact state due to sliding resistance such a reaction force from a seal in contact with the container shutter 602 under pressure. This contact state is retained during recording (image formation) but when the knob 603 is rotated in an opposite direction in order to close the container shutter 602 to rotate a gear of the driving force transmitting portion 603*a* in a direction of an arrow F, only the gear of the driving force transmitting portion is rotated to start separation of the teeth K and M from each other as shown in FIG. 16(*b*). Thereafter, as shown in FIG. 16(*c*), tooth L and tooth M come in contact with each other. During this period, the driving force cannot be transmitted from the driving force transmitting portion 603*a* to the driving force relay portion 502. By further rotating the driving force transmitting portion 603*a* in the direction of the arrow F, the driving force transmitting portion 603*a* starts to rotate the gear of the driving force relay portion 502 in a direction of an arrow H.

With respect to the above constituted toner container 600, as shown in FIG. 14(*b*), three or four drive gears are ordinarily provided. At an engaging portion between respective gears, loss by the backlash is caused to occur to lead to a non-negligible deviation as a whole. As a result, even when the knob 603 is returned to the original position, such a phenomenon that the container shutter 602 and the main assembly shutter 505 are not returned to their original positions is caused to occur. For this reason, the knob 603 provided to the toner container 600 has been conventionally constituted so that the container shutter 602 and the main assembly shutter 505 can be restored to their original positions by providing the knob 603 with such a structure that it can be much rotated in a shutter close direction compared with a shutter open direction.

Incidentally, demands for a further reduction in mounting space of the main assembly of image forming apparatus and an improvement in operability have been still increased, so that arrangement of consumable articles such as the developer supply container (toner cartridge) and a removal direction of the developer supply container are of increasing importance. For the reduction in mounting space, it is effective to set the removal direction of the consumable article and an access direction into the main assembly such as a housing open/close direction during clearance of paper jam as uniform as possible. As a result, the apparatus main assembly is provided with a side surface free from an open/close door, so that there is no need to ensure a space for opening and closing the door at the side surface at the time of mounting the image forming apparatus, thus being very effective for space saving. Further, a single function printer having no image reading mechanism is improved in operability by setting the consumable article removal direction as an upward direction of the main assembly since the image reading mechanism covering an upper portion of the image forming apparatus is not employed.

In view of this point, e.g., as shown in FIGS. 2(*a*) and 2(*b*), it can be considered that an image forming apparatus is provided with a toner cartridge cover 23 at an upper surface thereof and a toner cartridge 31 is mounted from above the image forming apparatus. With respect to the toner cartridge 31, it can be considered that an unshown container shutter and an unshown apparatus shutter are opened and closed by rotationally driving a handle 36 in place of the knob 603.

Even in the case where such a constitution is employed, similarly as in the case of the conventional toner container 600 inserted from a side surface of the apparatus main assembly, there arises the backlash problem. For this reason, it is necessary to adopt such a constitution that the toner container 31 cannot be removed until the main assembly shutter and the container shutter are closed with reliability. Particularly, with respect to the main assembly shutter, there is a possibility that the deviation of the shutter resulting from the backlash is accumulated when the shutter is closed plural times in repetitive use even when the deviation by one closing operation is within an allowance. For this reason, during repetition of replacement of the toner container 31, there are possibilities that the developer receiving opening cannot be finally closed and that the container shutter and the main assembly shutter cannot be engaged with each other in order to ensure conjunction of the container shutter with the main assembly shutter. Accordingly, return of the main assembly shutter to the original position should be observed carefully.

Further, in order to realize size reduction of the image forming apparatus as a whole, when the respective toner containers 31 are disposed closely, a size of the handle 36 is restricted, so that an amount of rotational movement of the toner container is also restricted. For this reason, in order to ensure the same amount of rotational movement for each mounting of the toner container 31, it is necessary to engage the toner container 31 with the gear drive mechanism of the apparatus main assembly while retaining an initial position of the handle 36. Accordingly, it is necessary to dispose an axial direction of the handle 36 to be perpendicular to the insertion direction of the toner container 31 and dispose the drive mechanism of the apparatus main assembly to be substantially under the toner container 31 (downstream in the insertion direction of the developer supply container). In that case, a force is exerted on the gar drive mechanism in such a direction that the gears are separated from each other, i.e., that the toner container 31 is pulled out. Thus, it is necessary to provide such a constitution that the toner container 31 can be held simply with reliability. Incidentally, the conventional toner container 600 had the insertion direction, thereof into the apparatus main assembly, identical to the rotational axis direction of the knob 603, so that it was possible to easily hold the toner container 600 with respect to a force for separating the gears from each other, i.e., a force exerted in a vertical direction of the rotational axis of the rotation member by holding a guide rail 604 of the toner container 600 with a main assembly guide 506.

When the above described opening and closing mechanism of the shutters and the holding mechanism of the toner container 31 are intended to be realized as an automatic control mechanism, an increase in production cost is caused to occur. Further, when the respective operations for opening and closing the shutters and for holding the developer supply container are intended to be performed manually, the number of steps for performing replacement operation of the developer supply container is increased, so that there is a possibility that the increased steps lead to a poor operability.

DISCLOSURE OF THE INVENTION

An object of the present invention is to provide a developer supply container, detachably mountable to a main assembly of an image forming apparatus, capable of returning a main assembly shutter to an initial position with reliability during removal thereof and capable of being mounted and demounted reliably and simply.

Another object of the present invention is to provide an image forming apparatus to which the developer supply container is detachably mountable.

According to an aspect of the present invention, there is provided a developer supply container detachably mountable to a main assembly of an electrophotographic image forming apparatus, comprising:

a developer containing portion for containing a developer;

a developer discharge opening to be disposed opposite to a developer receiving opening provided in the apparatus main assembly when the developer supply container is mounted into the apparatus main assembly;

a container-side engaging portion for fixing the developer containing portion by being engaged with a main assembly-side engaging portion provided in the apparatus main assembly when the developer supply container is mounted into the apparatus main assembly;

an operation member capable of performing a moving operation in a mounted state of the developer supply container; and a transmitting portion, provided in the operation member, for transmitting a driving force for opening and closing the developer discharge opening to a relay portion, provided in the apparatus main assembly, for opening and closing the developer discharge opening;

wherein, in the mounted state of the developer supply container, the operation member is capable of opening and closing a main assembly shutter member, provided in the apparatus main assembly, for opening and closing the developer discharge opening through the relay portion;

wherein the container-side engaging portion is movable by movement of the operation member so that it retains engagement thereof with the main assembly-side engaging portion when the operation member is moved in a opening direction for opening the main assembly shutter member and so that it releases the engagement with the main assembly-side engaging portion when the operation member is moved in a closing direction for closing the main assembly shutter member; and wherein a position of the operation member when the container-side engaging portion is located in a position to release the engagement with the main assembly-side engaging portion is away, in the closing direction, from a position thereof when the container-side engaging portion is located in a position to be engaged with the main assembly-side engaging portion during mounting of the developer supply container.

According to another aspect of the present invention, there is provided an electrophotographic image forming apparatus having a main assembly to which a developer supply container is detachably mountable, the image forming apparatus, comprising:

a developer receiving opening to be disposed opposite to a developer discharge opening of the developer supply container to be mounted;

a main assembly shutter member for opening and closing the developer receiving opening;

a main assembly-side engaging portion for being engaged with a container-side engaging portion of the developer discharge opening of the developer supply container to be mounted; and a relay portion, connected with a transmitting portion which is provided in an operation member of the developer supply container so as to transmit a driving force for opening and closing the developer discharge opening, for transmitting a driving force for opening and closing the developer receiving opening to the main assembly shutter member;

wherein, in the mounted state of the developer supply container, the operation member is moved to transmit the driving force from the transmitting portion to the a main assembly shutter member, through the relay portion to enable an operation for opening and closing the main assembly shutter member;

wherein the container-side engaging portion is movable by movement of the operation member so that it retains engagement thereof with the main assembly-side engaging portion when the operation member is moved in a opening direction for opening the main assembly shutter member and so that it releases the engagement with the main assembly-side engaging portion when the operation member is moved in a closing direction for closing the main assembly shutter member; and wherein a position of the operation member when the container-side engaging portion is located in a position to release the engagement with the main assembly-side engaging portion is away, in the closing direction, from a position thereof when the container-side engaging portion is located in a position to be engaged with the main assembly-side engaging portion during mounting of the developer supply container.

These and other objects, features and advantages of the present invention will become more apparent upon a consideration of the following description of the preferred embodiments of the present invention taken in conjunction with the accompanying drawings.

BEST MODE FOR CARRYING TO THE INVENTION

Embodiments of a developer supply container and an image forming apparatus according to the present invention will be described with reference to the drawings.

(General Structure)

Figure 1:
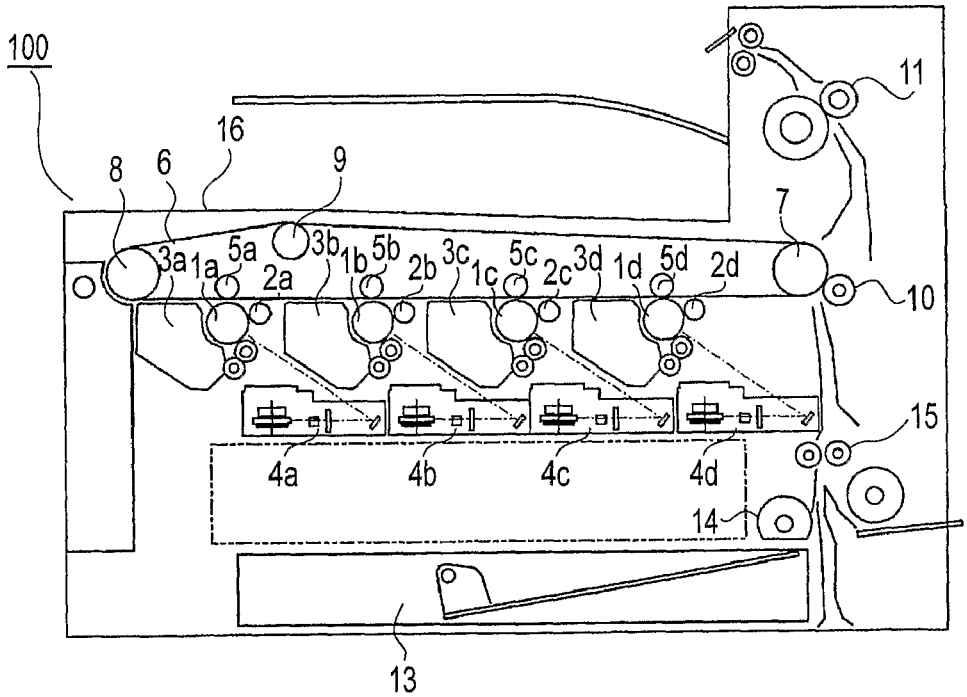
FIGS. 1(*a*) and 1(*b*) are schematic explanatory views of a main assembly of an image forming apparatus.
Figure 1:
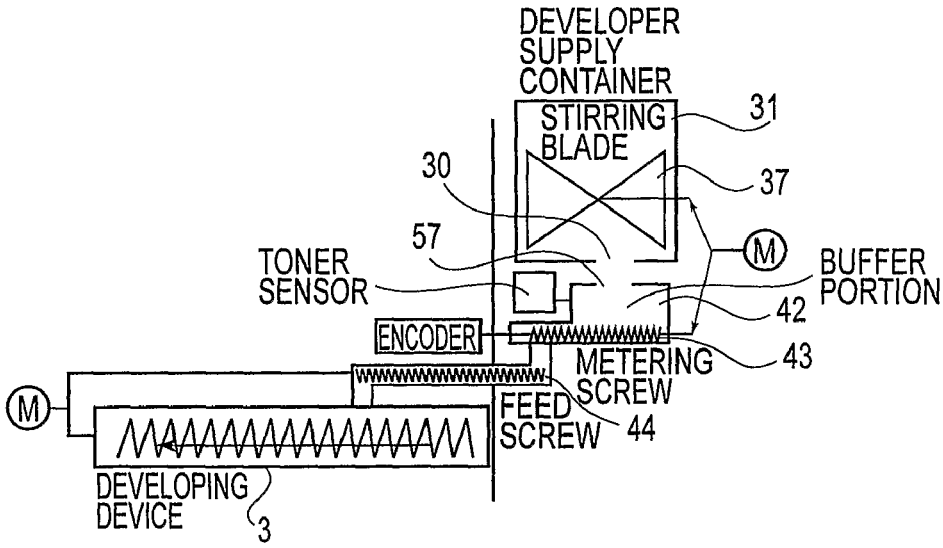
Figure 2:
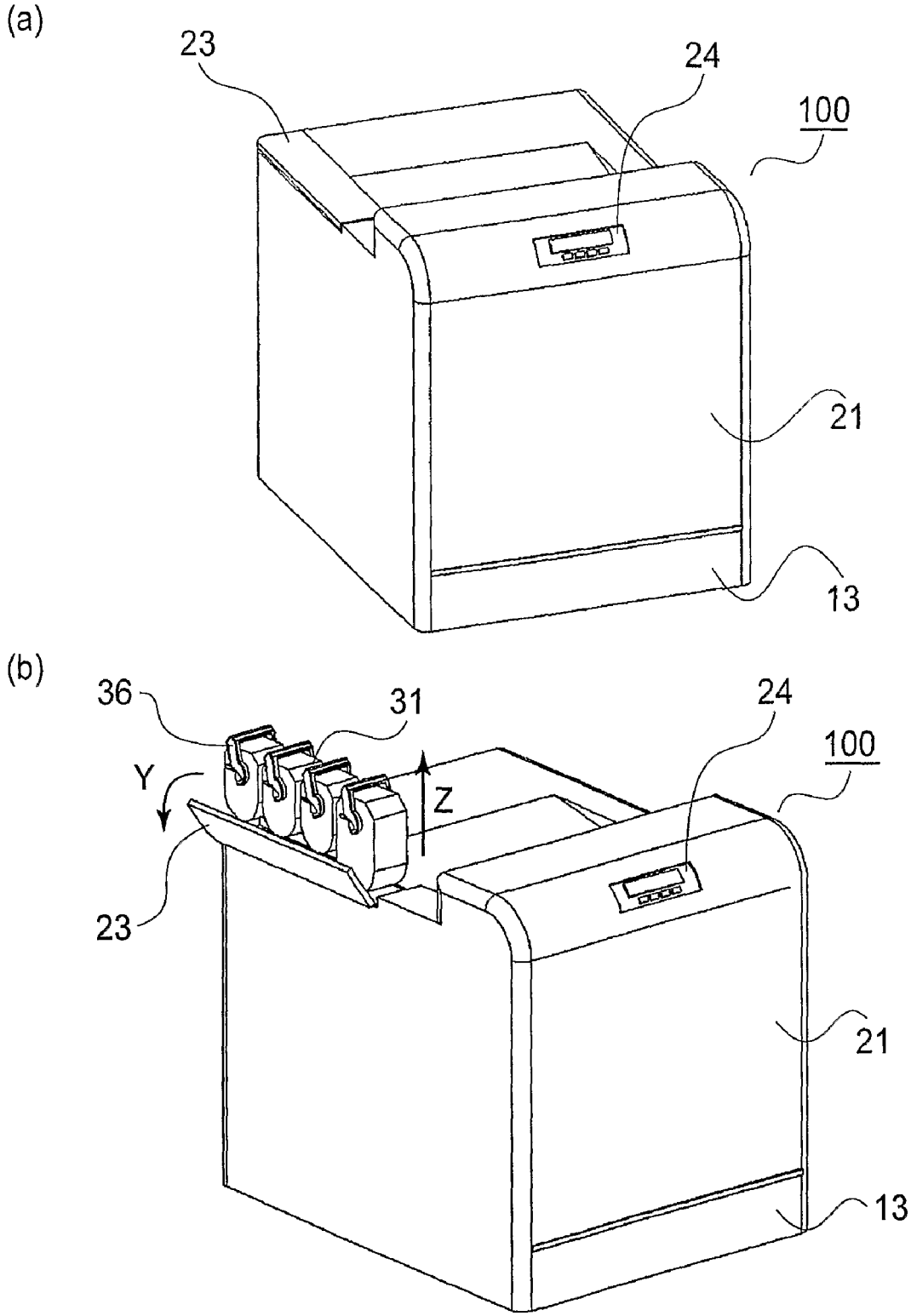
FIGS. 2(*a*) and 2(*b*) are external perspective views of the image forming apparatus main assembly.

A main assembly 100 of an image forming apparatus according to this embodiment and a developer supply container to be mounted into the image forming apparatus main assembly 100 will be described with reference to the drawings. First, a general structure of the image forming apparatus main assembly 100 will be described with reference to FIGS. 1 and 2. FIG. 1(*a*) is a schematic sectional view of the image forming apparatus main assembly 100 of this embodiment as seen in a left side surface of the image forming apparatus; FIG. 1(*b*) is a conceptual view showing a conveyance process of developer from the developer supply container to the image forming apparatus main assembly 100; FIG. 2(*a*) is an external perspective view of the image forming apparatus main assembly 100; and FIG. 2(*b*) is an external perspective view for illustrating a state of the image forming apparatus main assembly 100 during replacement of the developer supply container.

In FIG. 1(*a*), a front surface of the image forming apparatus is located on a right side on the drawing. Further, as shown in FIG. 2(*a*), the image forming apparatus is provided with a display operation portion 24 at an upper portion thereof, so that a housing cover 21, a sheet (paper) feeding cassette 13, and the like for releasing a conveyance path for paper jam treatment are operable from the front surface of the image forming apparatus.

Inside the image forming apparatus, as shown in FIG. 1(*a*), four photosensitive drums 1*a*, 1*b*, 1*c* and 1*d* as image bearing members for respective colors are disposed and from which respective color images are transferred onto an intermediary transfer belt 6 as an intermediary transfer belt 6 in a superposition manner, thus providing a full-color image. Accordingly, the image forming apparatus is a four drum-type (in-line) printer and achieves high speed by utilizing the four drums. The photosensitive drums 1*a* to 1*d* and developing devices 3*a* to 3*d* are disposed, in series in a substantially horizontal direction, vertically below the intermediary transfer belt 6, and are used for forming images of yellow, magenta, cyan, and black, respectively. A toner cartridge (e.g., a toner cartridge 31) as an example of each of developer supply containers for supplying developer to the developing devices 3*a* to 3*d*, respectively, is constituted so that it can be replaced from above the image forming apparatus. A surface of each of the photosensitive drums 1*a* to 1*d* is electrically charged uniformly by an associated one of charging apparatuses 2*a* to 2*d*. Thereafter, on the surface of each photosensitive drum, a latent image is formed by an associated one of exposure apparatuses 4*a* to 4*d* and is developed with developer to form an associated color toner image. The resultant four color toner images formed on the (four) photosensitive drums 1*a* to 1*d* are primary-transferred onto the intermediary transfer belt 6 in a superposition manner by primary transfer rollers 5*a* to 5*d*, respectively, thus forming a (full-) color toner image. The intermediary transfer belt 6 is extended under tension around a drive roller 7, a follower roller 8, and a tension roller 9 and are rotated around these rollers. The toner image on the intermediary transfer belt 6 is secondary-transferred onto a sheet by a secondary transfer roller 10. The sheet has been feed from a sheet feeding cassette 13 by a pickup roller 14 and conveyed to a secondary transfer portion while being timed to rotation of the intermediary transfer belt 6 by a pair of registration rollers 15. The sheet onto which the color toner image is transferred is subjected to application of heat and pressure by a fixing device 11 to fix the color toner image thereon, followed by discharge out of the image forming apparatus.

Four toner cartridges 31 into which fresh developers of four colors are filled, respectively, are mounted into the image forming apparatus main assembly 100. As shown in FIG. 1(*b*), inside of each toner cartridge 31, a stirring member 37, as described specifically later with reference to FIG. 3(*c*), is disposed and is rotated to permit discharge of developer from a developer discharge opening 30 of the toner cartridge 31. As a result, the developer is accumulated in a buffer portion 42. Below the buffer portion 42, a developer metering screw 43 and a conveyance screw 44 are disposed so as to convey the developer in the buffer portion 42 into a process cartridge. An amount of the developer fed by the developer metering screw 43 is divided into a plurality of portions equal in amount to each other at a space between a screw pitch and a pipe, so that it is possible to adjust a discharge amount of developer by an amount of rotation of the developer metering screw 43. The rotation amount of the developer metering screw 43 is determined from a video count value on the basis of a predetermined table, so that an appropriate amount of toner is discharged from the developer metering screw 43. During recording (image formation), the toner is fed into the developing device 3 by the conveyance screw 44 which is always rotating. Further, depending on the rotation amount of the developer metering screw 43, the stirring member 37 of the toner cartridge 31 is rotated, so that toner is supplied from the toner cartridge 31 to the buffer portion 42 to keep the amount of toner in the buffer portion 42 at a constant level.

At the buffer portion 42, an unshown toner sensor is disposed and sends a signal to a controller portion when the toner in the toner cartridge 31 is used up and is not discharged into the buffer portion 42 and thus the toner in the buffer portion 42 is used up, so that notification that a developer supply container for which color is emptied out is provided to a user. The user opens a cartridge cover 23 of the main assembly 100 in Y direction on the basis of the information from the main assembly 100 and takes the empty toner cartridge 31 out of the main assembly 100 in Z direction, and then mounts a new toner cartridge 31 in the main assembly 100. Thereafter, when the cartridge cover 23 is closed, a driving force is transmitted to the stirring member of the toner cartridge 31 on the basis of a signal from the controller portion, so that the inside of the buffer portion is refilled with toner to be returned to a recordable state.

Further, each of the photosensitive drums 1*a* to 1*d* is constituted so as a process cartridge detachably mountable to the image forming apparatus main assembly. The process cartridge may include either one of the primary charge roller and the developing device, in addition to the photosensitive drum. In this embodiment, the photosensitive drum 1, the charging apparatus 2, and the developing device 3 are integrally disposed in the process cartridge. At an upper surface of the image forming apparatus, an openable and closable top cover 16 is disposed so as to permit replacement of the process cartridge integrally supporting the photosensitive drum, the developing device 3, and the like, and replacement of the intermediary transfer belt 6.

Here, as described above, with a demand for reduction in mounting space in a user office, the image forming apparatus main assembly 100 is required to be designed as a compact one, so that the above described respective members have to be designed to be compact in size and have to be disposed efficiently. Particularly, in the full-color image forming apparatus as in this embodiment, it is important to perform more efficient design since the toner cartridge 31, a developer supply container mounting portion 17 for mounting the toner cartridge 31 described later, the driving force transmitting mechanism, and the like are disposed four by four.

Further, in the image forming apparatus main assembly 100 in this embodiment, the design is performed in view of space saving with respect to not only the mounting space when the image forming apparatus main assembly 100 is mounted but also spaces (such as a space for opening the cover the main assembly and a space for mounting the toner cartridge 31) necessary to replace the toner cartridge 31. Further, as shown in FIG. 2(*b*), a method of inserting the toner cartridge 31 from above the image forming apparatus main assembly 100 is adopted.

(Developer Supply Container)

Figure 3:
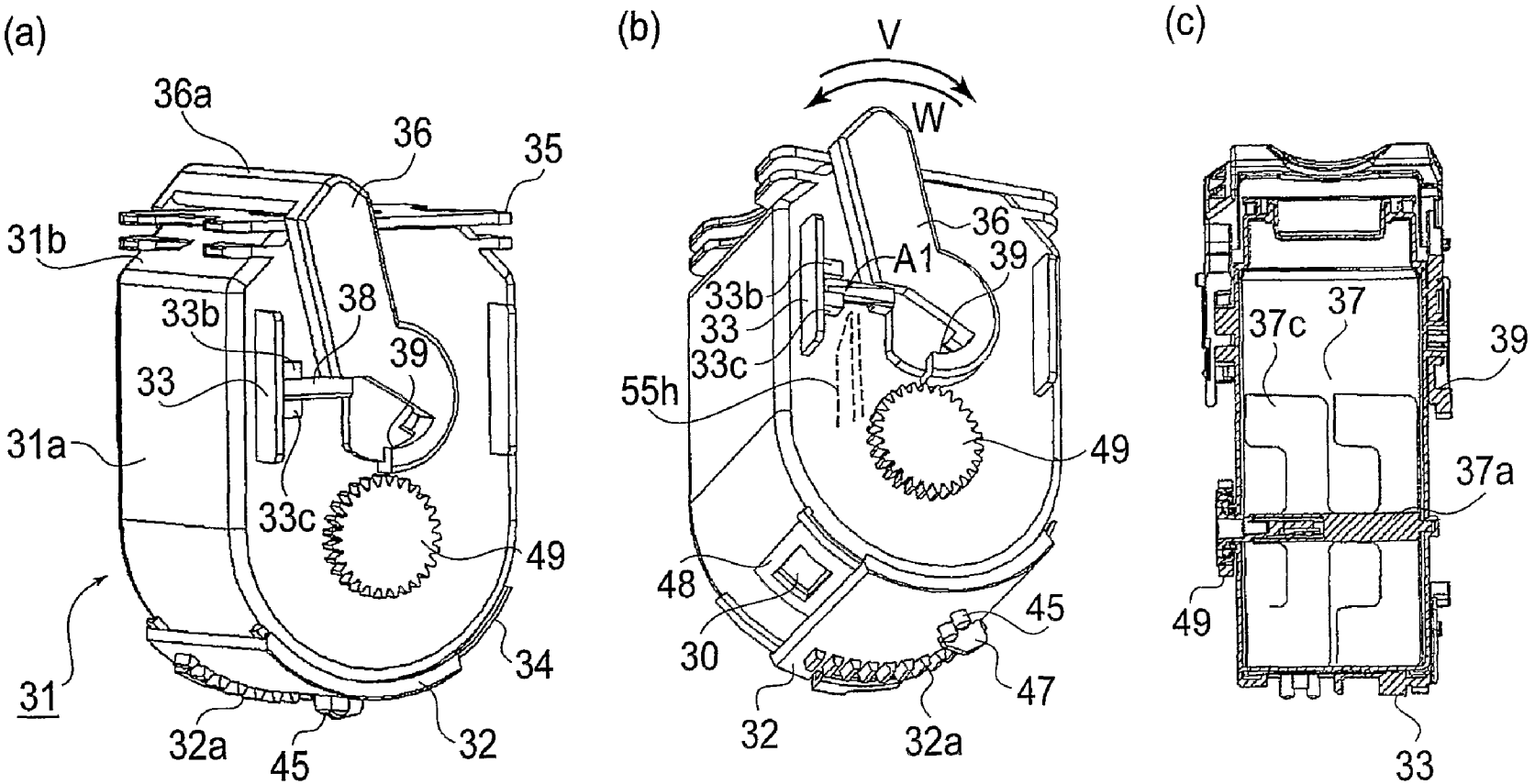
FIGS. 3(*a*) and 3(*b*) are perspective views of a toner cartridge including a front surface thereof, and FIG. 3(*c*) is a sectional view of the toner cartridge.
Figure 4:
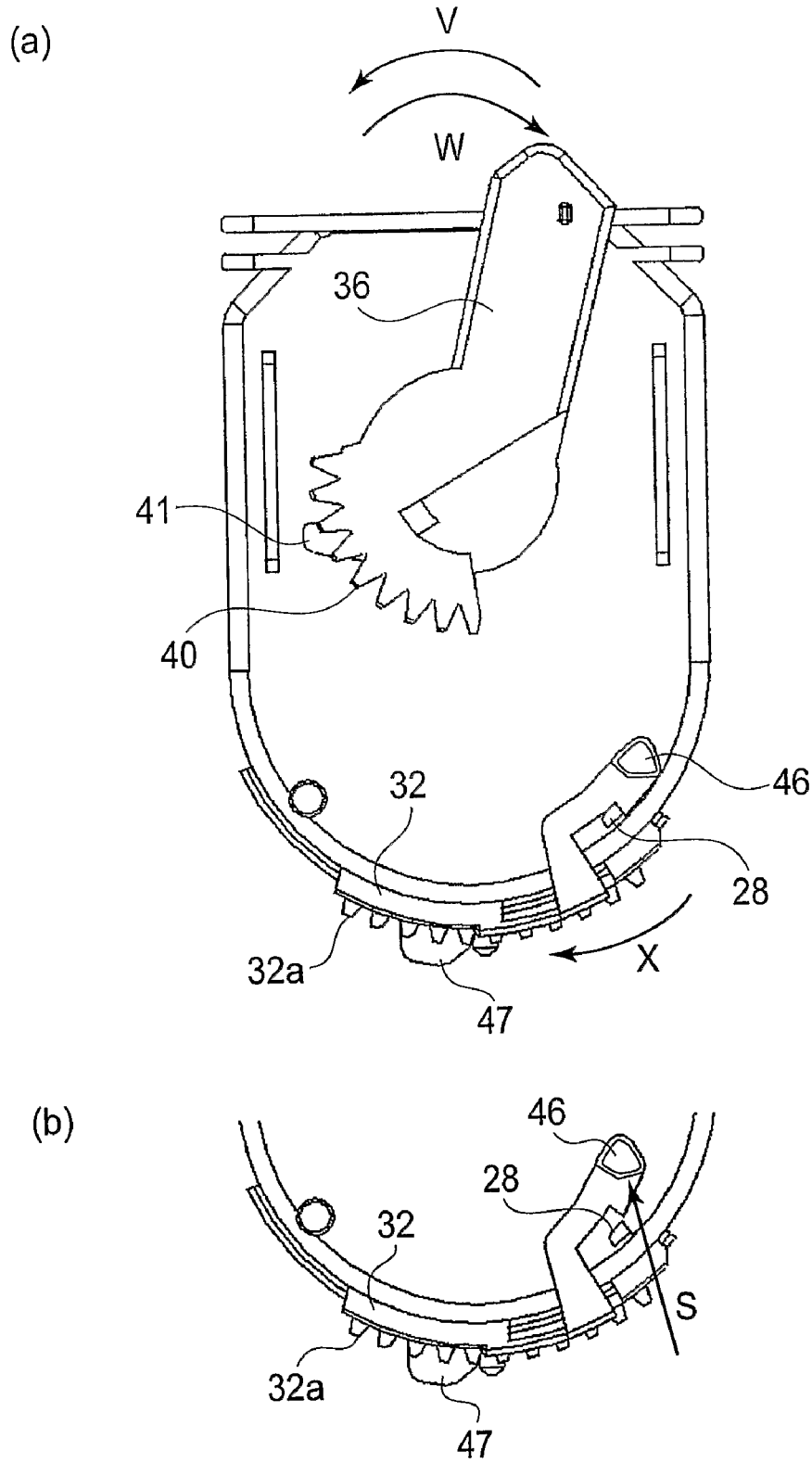
FIGS. 4(*a*) and 4(*b*) are rear views of the toner cartridge.
Figure 5:
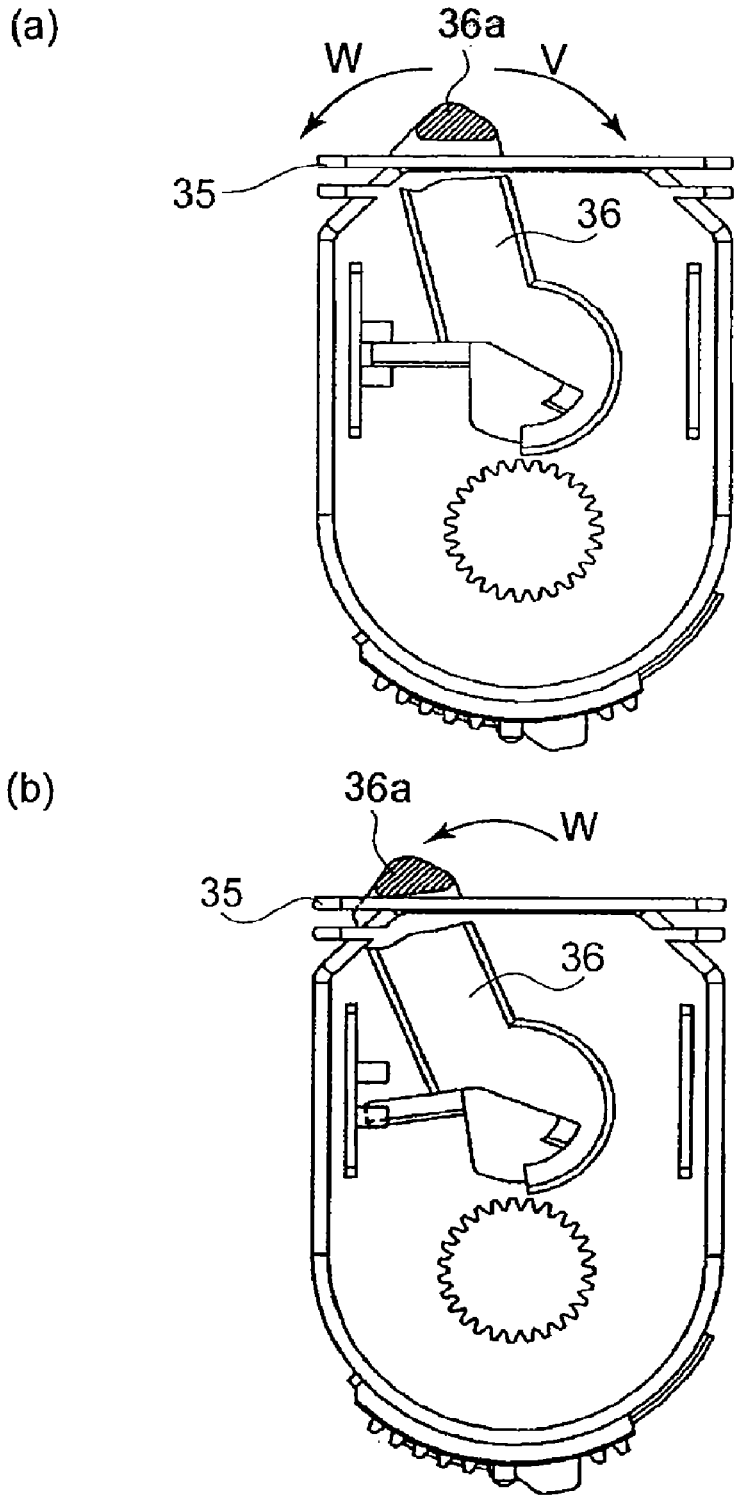
FIGS. 5(*a*) and 5(*b*) are explanatory views of rotational movement of a handle of the toner cartridge.
Figure 6:
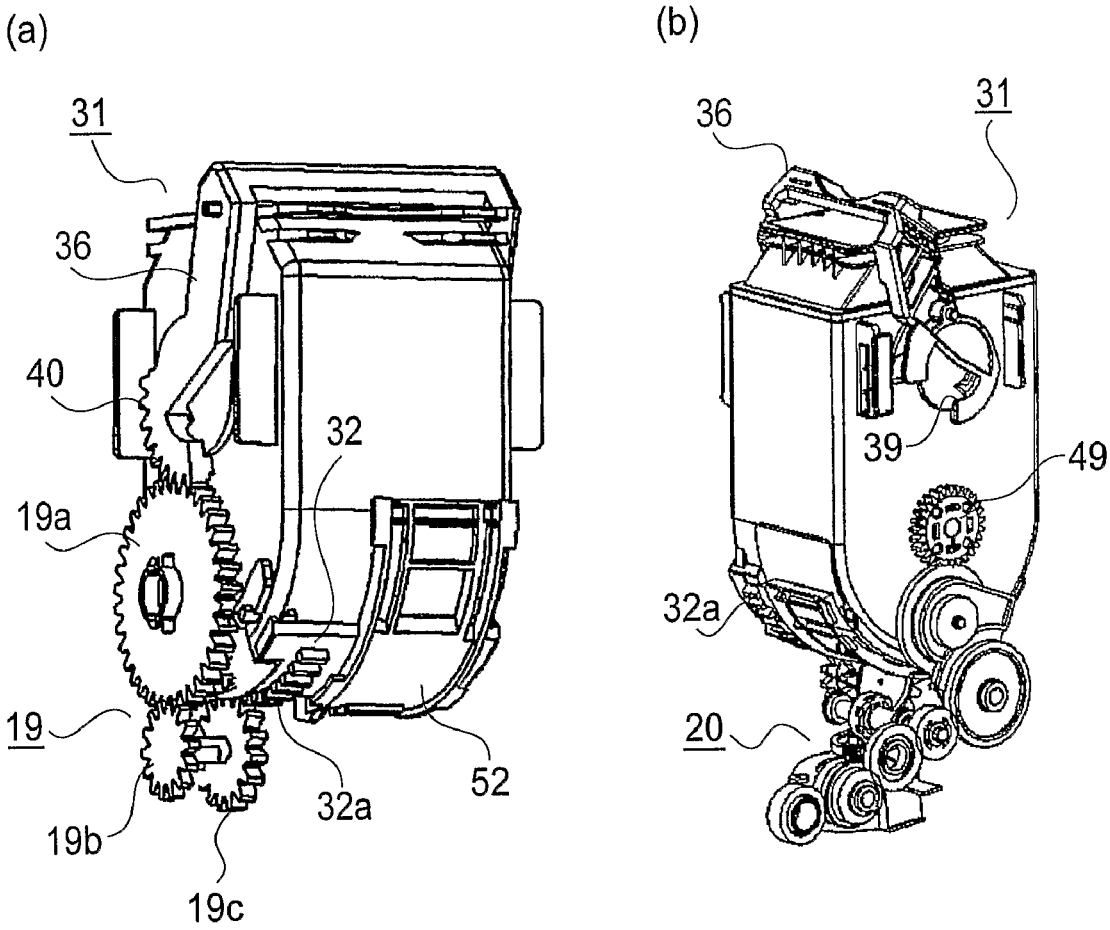
FIGS. 6(*a*) and 6(*b*) are schematic views for illustrating a driving force transmitting mechanism.
Figure 7:
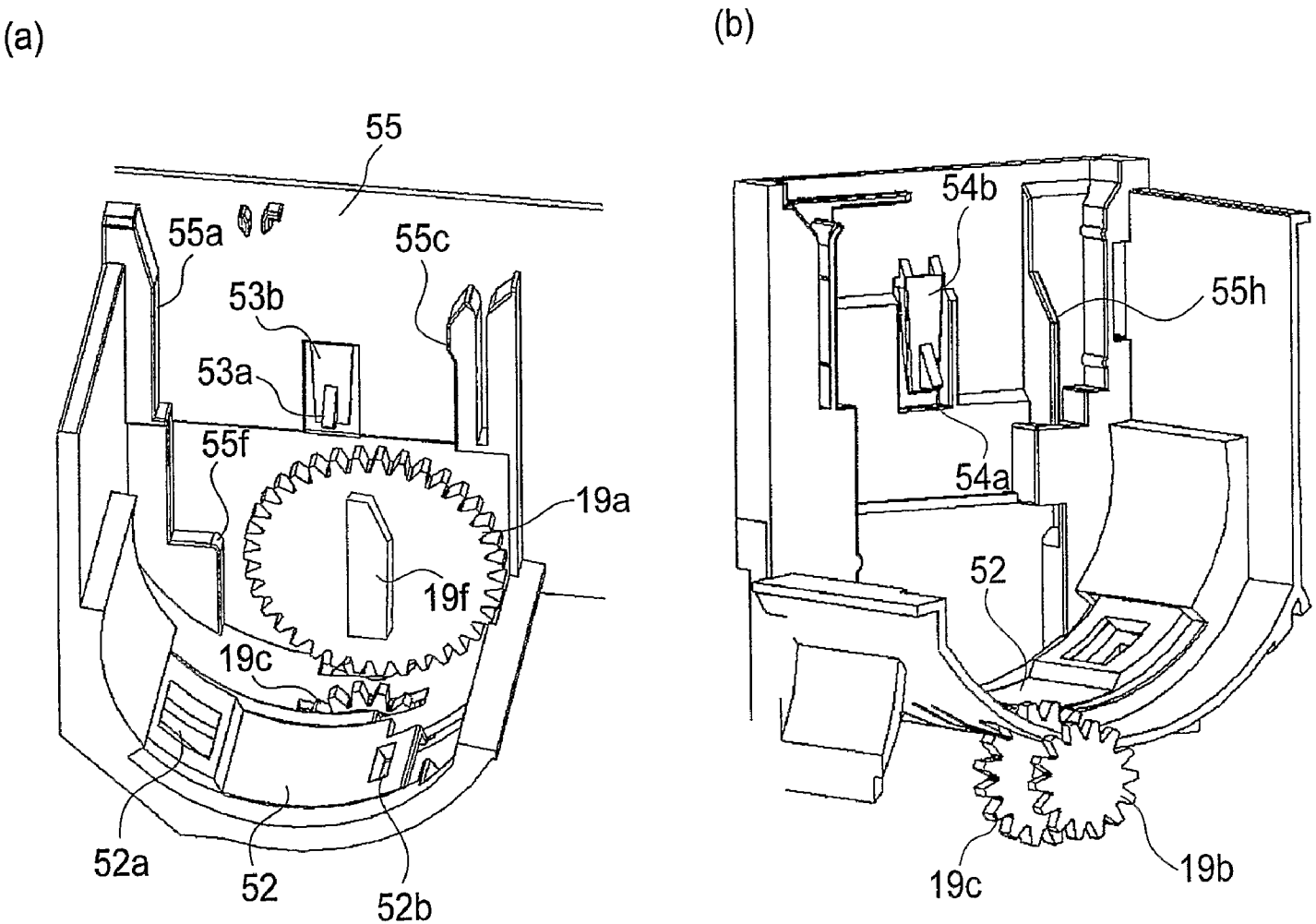
FIGS. 7(*a*) and 7(*b*) are explanatory views of a toner supply apparatus frame member of the image forming apparatus main assembly.
Figure 8:
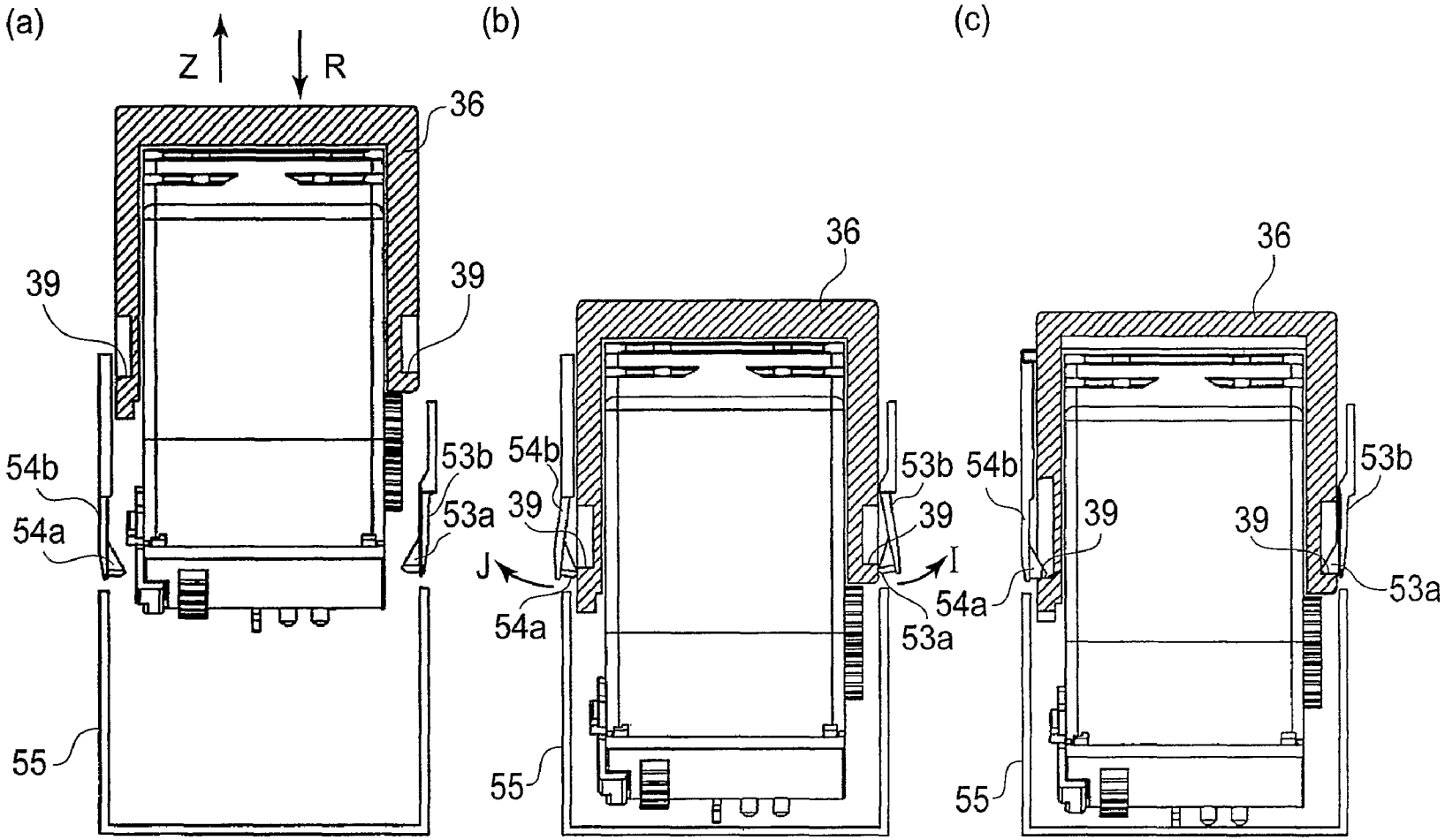
FIGS. 8(*a*), 8(*b*) and 8(*c*) are schematic views for illustrating a mounting operation of a developer supply container.
Figure 9:
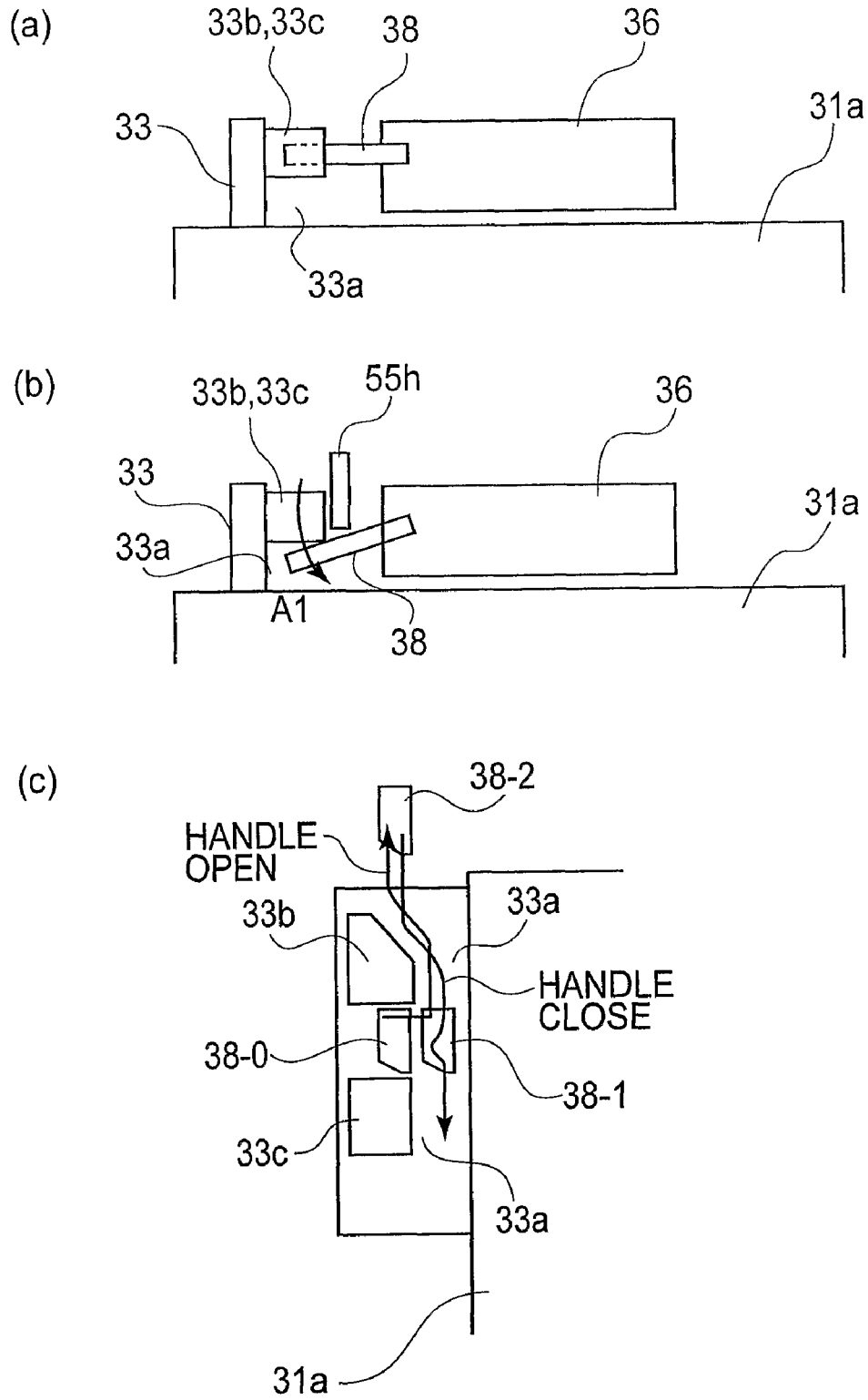
FIGS. 9(*a*), 9(*b*) and 9(*c*) are schematic views for illustrating a lock release mechanism of the handle.
Figure 10:
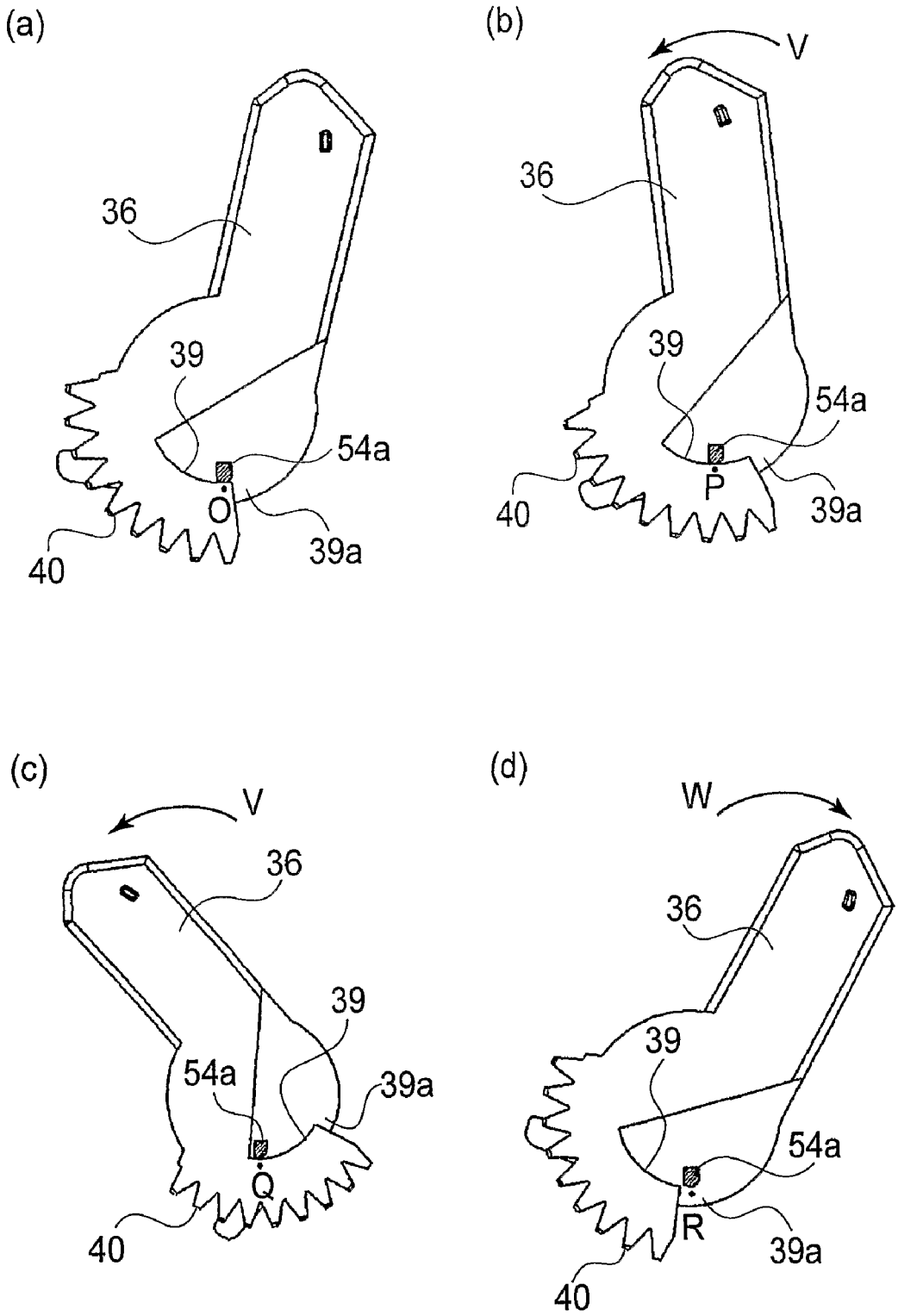
FIGS. 10(*a*) to 10(*d*) are schematic views for illustrating a relationship between an amount of rotational movement.
Figure 11:
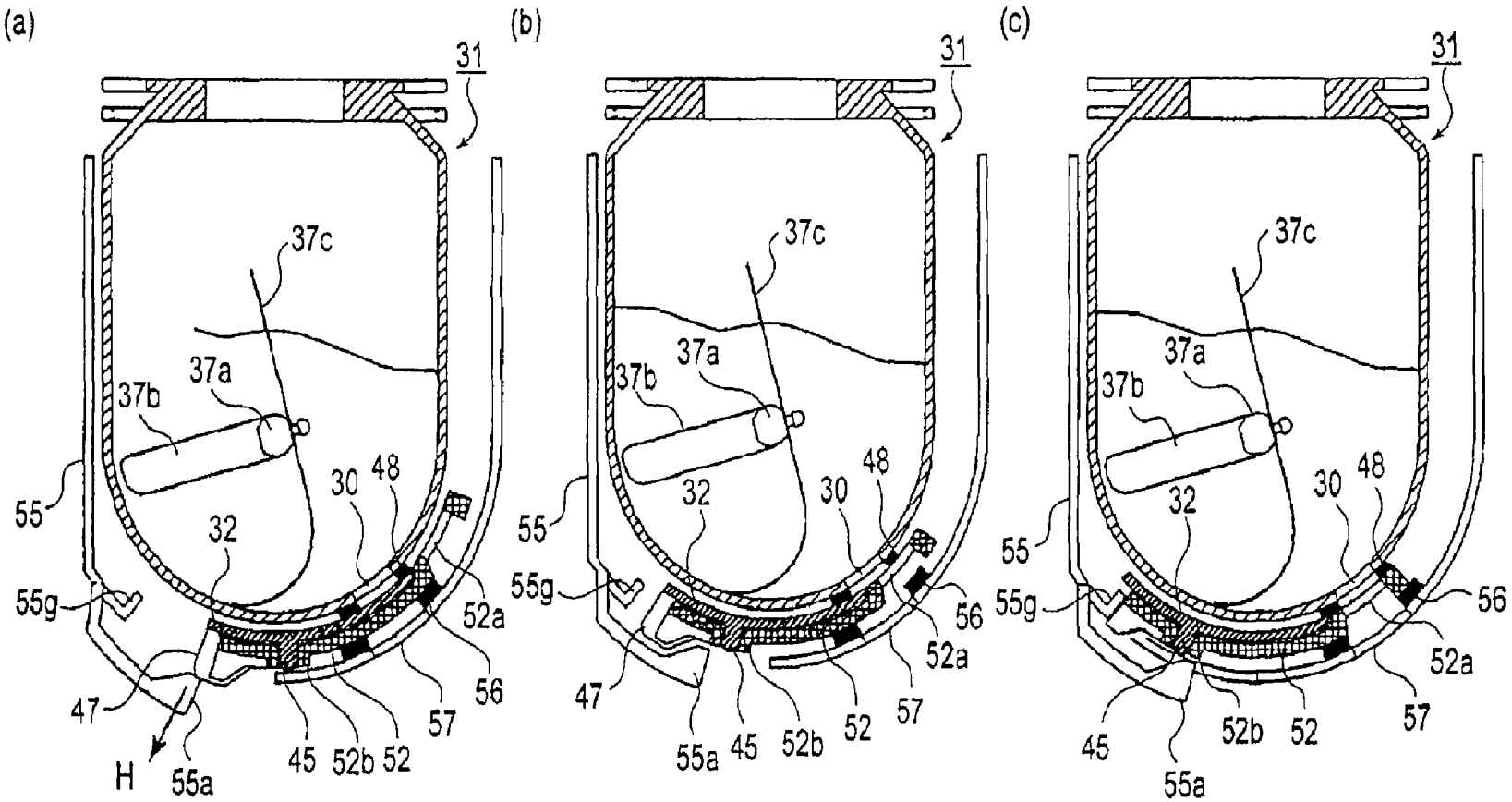
FIGS. 11(*a*), 11(*b*) and 11(*c*) are schematic views for illustrating a shutter.
Figure 12:
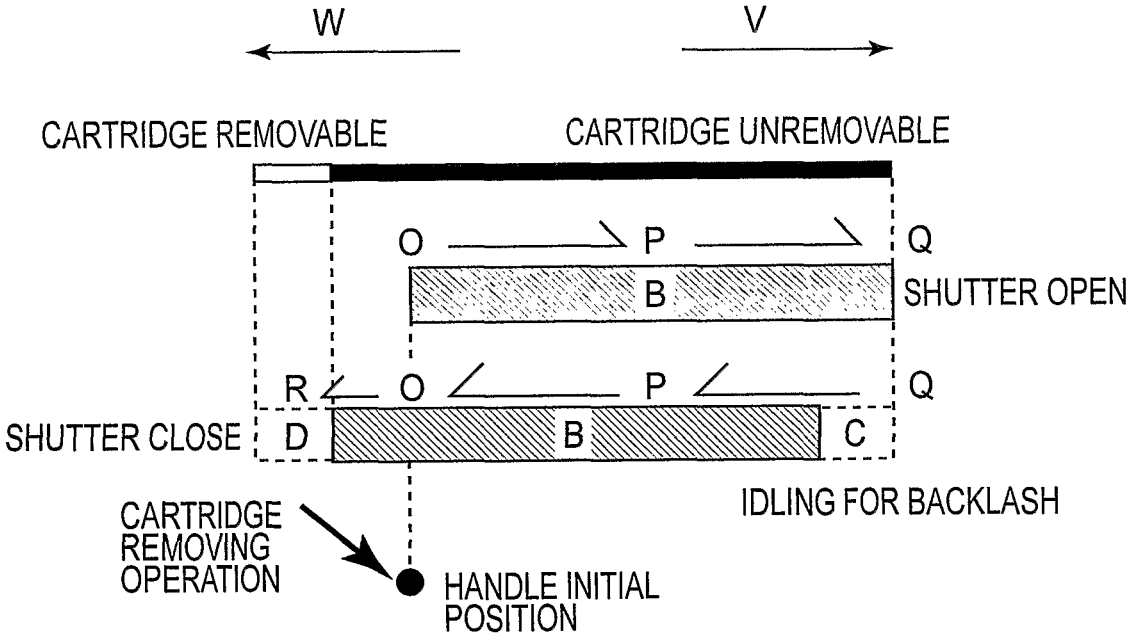
FIG. 12 is a schematic view for illustrating an amount of rotational movement and an operation of the shutter.
Figure 13:
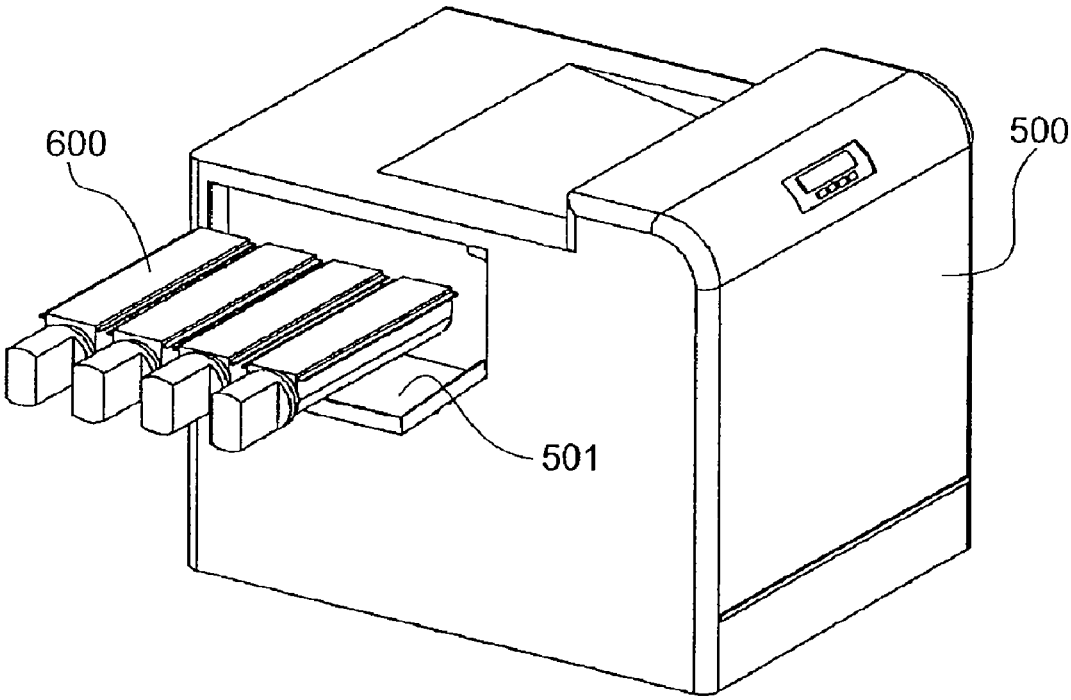
FIG.13 PRIOR ART
FIG. 13 is an explanatory view of a conventional image forming apparatus.
Figure 14:
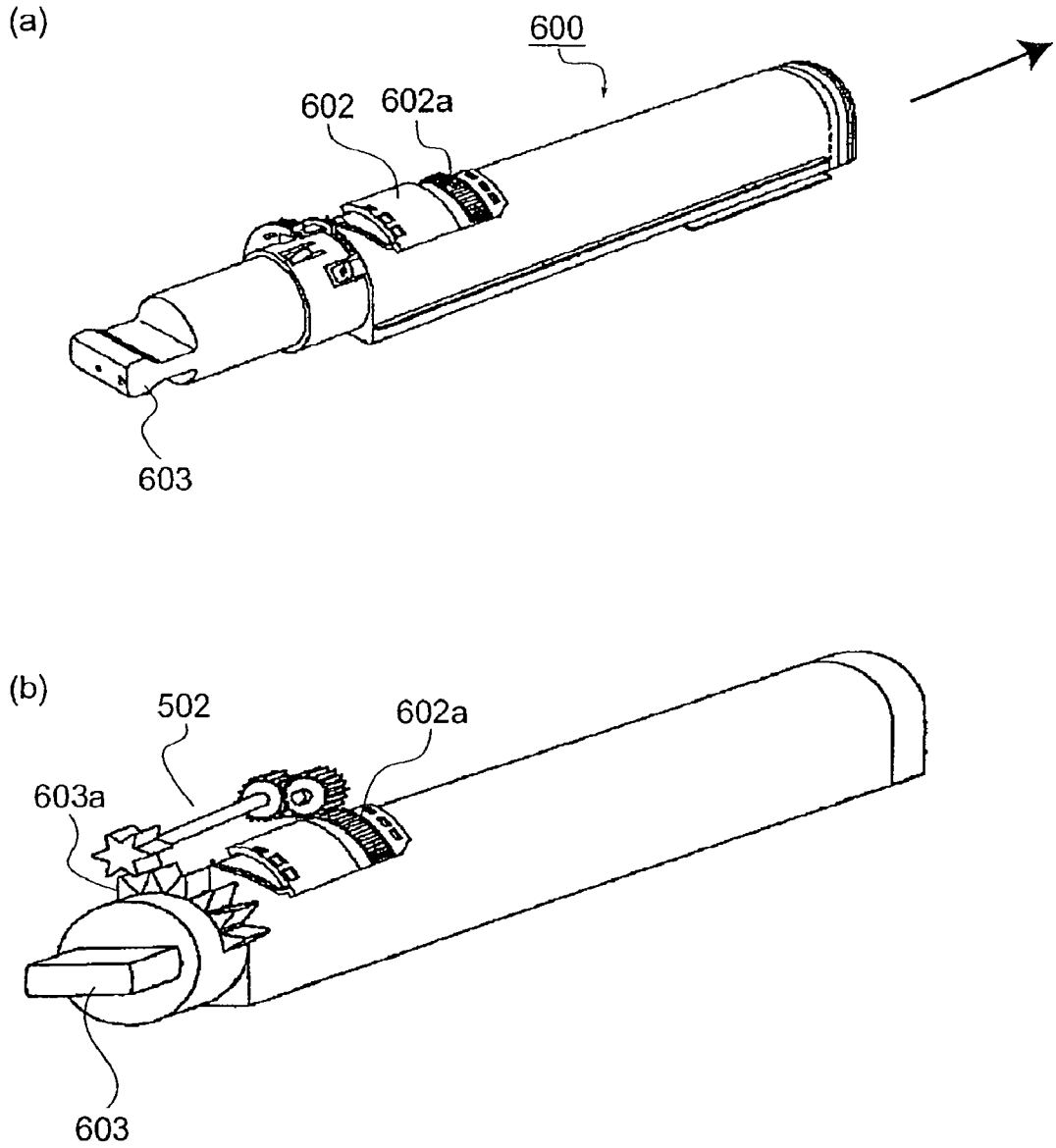
FIG.14 PRIOR ART
FIGS. 14(*a*) and 14(*b*) are explanatory views of a conventional developer supply container.
Figure 15:
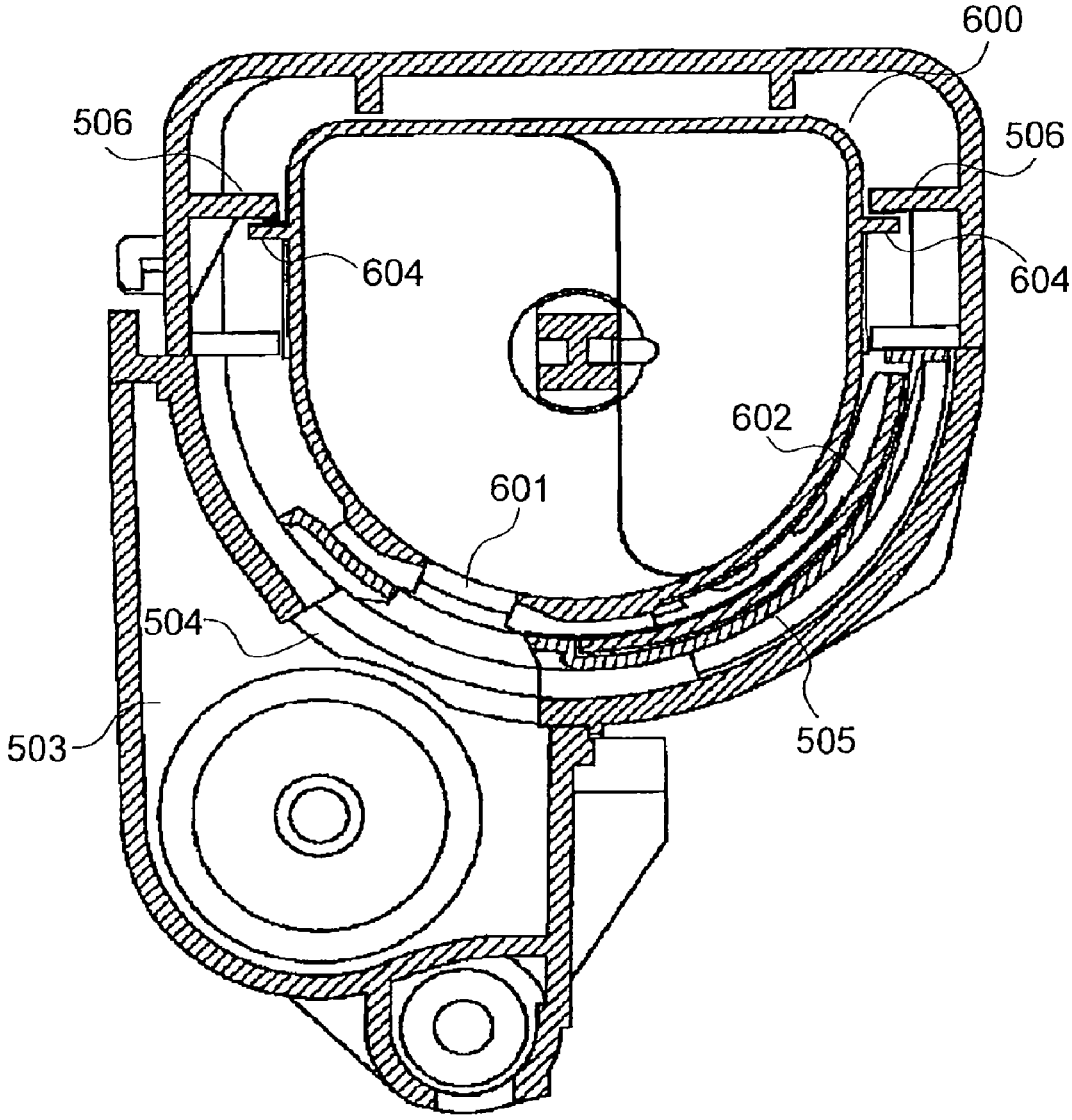
FIG.15 PRIOR ART
FIG. 15 is a sectional view for illustrating a mounted state of the conventional developer supply container.
Figure 16:
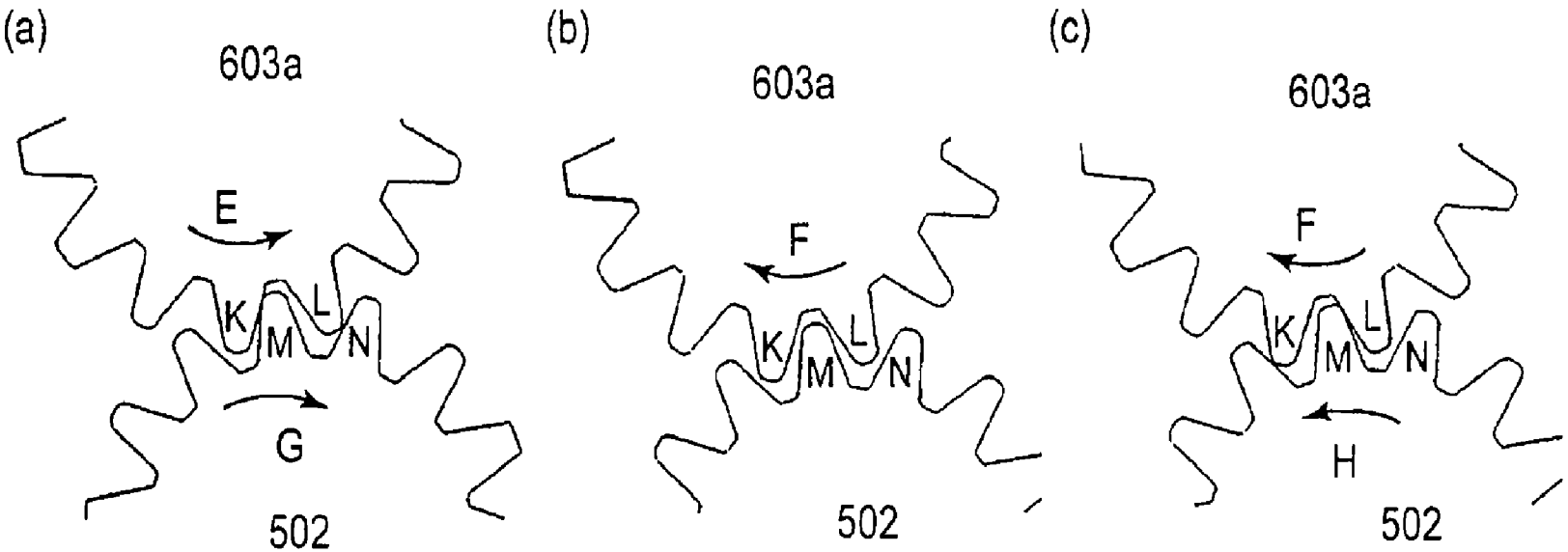
FIG.16 PRIOR ART
FIGS. 16(*a*), 16(*b*) and 16(*c*) are schematic views for illustrating backlash of gears.

Next, the toner cartridge 31 of this embodiment will be described with reference to the drawings. FIGS. 3(*a*) and 3(*b*) are perspective views of a toner cartridge including a front surface thereof, and FIG. 3(*c*) is a sectional view of the toner cartridge. FIGS. 4(*a*) and 4(*b*) are rear views of the toner cartridge. FIGS. 5(*a*) and 5(*b*) are explanatory views of rotational movement of a handle of the toner cartridge. FIGS. 6(*a*) and 6(*b*) are schematic views for illustrating a driving force transmitting mechanism. FIGS. 7(*a*) and 7(*b*) are explanatory views of a toner supply apparatus frame member of the image forming apparatus main assembly. FIGS. 8(*a*), 8(*b*) and 8(*c*) are schematic views for illustrating a mounting operation of a developer supply container. FIGS. 9(*a*), 9(*b*) and 9(*c*) are schematic views for illustrating a lock release mechanism of the handle. FIGS. 10(*a*) to 10(*d*) are schematic views for illustrating a relationship between an amount of rotational movement. FIGS. 11(*a*), 11(*b*) and 11(*c*) are schematic views for illustrating a shutter. FIG. 12 is a schematic view for illustrating an amount of rotational movement and an operation of the shutter.

The toner cartridge 31 is mounted into the image forming apparatus main assembly 100 and gradually supplies developer to a portion to be supplied with the developer while being mounted as it is, thus being of a so-called stationary type. Incidentally, the toner cartridge 31 is mounted, at a position as shown in FIG. 2(*b*), to the image forming apparatus main assembly 100.

The toner cartridge 31 is, as shown in FIG. 3(*a*), provided with a handle 36 as an example of an operation member, a shutter rail 34, and a container shutter 32 slidable along the shutter rail 34. A toner container 31*a* is prepared by bonding a cover portion 31*b* thereto by a conventionally known means such as ultrasonic welding. As shown in FIG. 4(*b*), at a lower portion of the toner container 31*a*, a developer discharge opening 30 four supplying the developer is provided and a seal 48 is disposed so as to surround the developer discharge opening 30. Accordingly, when the container shutter 32 covers the developer discharge opening 30, a gap between the neighborhood of the developer discharge opening 30 and the container shutter 32 is sealed with the seal 48.

Inside the toner container 31*a*, as shown in FIG. 3(*c*), a stirring member 37 is disposed. The stirring member 37 is provided with a stirring blade 37*c* which is attached to a stirring shaft 37*a* and is rotated to function as means for feeding toner contained in the toner container 31*a* from the developer discharge opening. The stirring shaft 37*a* is disposed in a direction perpendicular to the insertion direction of the toner cartridge 31 and one end thereof is protruded out of the toner cartridge and provided with a stirring gear 49. The stirring gear 49 is engaged with a stirring drive mechanism 20 provided in the apparatus main assembly when the toner cartridge 31 is mounted into the main assembly, thus transmitting a driving force. The stirring drive mechanism 20 is a driving force transmitting mechanism comprising a gear train, and the stirring gear 49 comes close thereto from a direction perpendicular to the rotational axis, i.e., a direction perpendicular to a facewidth direction, and is engaged with the stirring drive mechanism 20.

To the container shutter 32, as shown in FIG. 4(*a*), a shutter lock 46 as an example of a container shutter locking portion is provided. In such a state that the toner cartridge 31 is not mounted into the apparatus main assembly, the shutter lock 46 is engaged with a shutter lock receiving portion 28, so that toner is not leaked out of the toner container due to the open of the container shutter 32 even when the container shutter 32 is erroneously slid in an open direction (indicated by an arrow X) by a user. Incidentally, the shutter lock 46 interferes with a shutter lock release projection 55*a* when the toner cartridge 31 is mounted into the image forming apparatus main assembly 100 (FIG. 7(*a*)), so that the shutter lock 46 is moved upward to release the engagement with the shutter lock receiving portion 28 as shown in FIG. 7(*b*), thus permitting movement of the container shutter 32.

The handle 36 is, as shown in FIGS. 3(*a*) and 4(*a*), axially supported at both side surfaces of the toner container 31*a* and can be rotationally moved in an open direction (arrow V direction) and a close direction (arrow W direction). However, as shown in FIG. 5(*b*), a grip portion 36*a* of the handle 36 abuts against a container grip 35 at an upper portion of the toner container 31*a*, so that a rotational movement angle is restricted. Further, as shown in FIG. 3(*a*), in the state that the toner cartridge 31 is not mounted into the apparatus main assembly, a handle lock 38 as an example of a lock means is held by an upper receiving portion 33, so that the handle 36 is fixed at a predetermined angle. The fixed position is an initial position of the handle 36 and as shown in FIG. 5(*a*), the handle 36 is set to be capable of being rotationally moved in both the V and W directions.

Further, the handle 36 is, as shown in FIG. 4(*a*), provided with a transmitting portion 40, for transmitting a driving force for opening and closing the developer discharge opening, comprising gears. The driving force transmitting portion 40 is, as shown in FIG. 5(*a*), engaged with a relay portion 19, for transmitting the driving force for opening and closing the developer discharge opening, provided in the apparatus main assembly to transmit the driving force to the driving force relay portion 19. The driving force relay portion 19 is a driving force transmitting mechanism comprising a gear train, and comes close to an idler gear 19*a* from a direction perpendicular to the rotational axis, i.e., a direction perpendicular to the face width direction, to be engaged with the idler gear 19*a*. The idler gear 19*a* is connected to a portion 32*a*, for receiving the driving force for opening and closing the developer discharge opening, provided in the container shutter 32, through a small stepped gear 19*b* and a large stepped gear 19*c*, thus transmitting the movement of the handle 36 as an open and close motion of the container shutter 32.

Further, the handle 36 is provided with a handle rail 39 as an example of a container-side engaging portion as shown in FIG. 3(*a*) and FIGS. 4(*a*) and 4(*b*). The handle rail 39 is a stepped member shaped in an arc around the rotational movement axis of the handle 36 and is engaged with projections 53*a* and 54*a* as an example of a main assembly-side engaging portion provided in the apparatus main assembly, thus fixing and holding the toner cartridge 31 with respect to the image forming apparatus main assembly. These projections 53*a* and 54*a* are disposed at ends of base portions 53*b* and 54*b* which are integrally formed with a toner supply apparatus frame 55 as shown in FIGS. 7(*a*) and 8(*a*). Each of the projections 53*a* and 54*a* has an inclined surface as an upper surface (on an upstream side in the toner cartridge 31 insertion direction) and a surface substantially perpendicular to the insertion direction as a lower surface (on a downstream side in the insertion direction). Operations and conditions of the handle rail 39 and the projections 53*a* and 54*a* will be described later in detail.

At an outer peripheral surface of the container shutter 32, as shown in FIG. 3(*b*), an engaging boss 45 is disposed so that it protrudes from the surface of the container shutter 32. On the other hand, the apparatus shutter 52 provided in the apparatus main assembly is provided with an engaging hole 52*b* for being engaged with the engaging boss 45 during the mounting of the toner cartridge 31 as shown in FIG. 7(*a*). As shown in FIGS. 11(*a*) to 11(*c*), the container shutter 32 and the apparatus shutter 52 cooperate in performing an open/close operation, so that three openings including a developer receiving opening 57 provided in the toner supply apparatus frame 55 of the apparatus main assembly, a toner supply opening 52*a* provided in the apparatus shutter 52, and the developer discharge opening 30 provided in the toner container 31*a*, communicate with each other. As a result, supply of the toner is performed. Around the developer receiving opening 57, a main assembly opening seal 56 is provided, so that leakage of the toner from a gap between the developer receiving opening 57 and the apparatus shutter 52.

<Operation During Mounting of Developer Supply Container>

An operation when the toner cartridge 31 is mounted will be described with reference to FIGS. 8(*a*) to 8(*c*).

First, a user opens the toner cartridge cover 23 of the image forming apparatus main assembly 100 in the Y direction (FIG. 2(*a*)). Then, as shown in FIG. 8(*a*), the user grips the container grip 35 at the upper portion of the toner container and starts to insert the toner cartridge 31 from above the main assembly into the toner supply apparatus frame 55 of the main assembly in a direction of an arrow R. At this time, the handle 36 is interposed between an upper handle lock receiving portion 33*b* and a lower handle lock receiving portion 33*c* of the toner container to be fixed at an initial position.

As shown in FIG. 8(*b*), the toner cartridge 31 is further inserted and when the inclined upper surfaces of the projections 53*a* and 54*a* contact the handle rail 39 of the handle 36, the base portions 53*b* and 54*b* of the projections 53*a* and 54*a* are elastically deformed. As a result, the projections 53*a* and 54*a* are moved outward in directions (indicated by arrows I and J), so that the toner cartridge 31 is inserted smoothly.

Further, as shown in FIG. 8(*c*), when the toner cartridge 31 is completely inserted, the projections 53*a* and 54*a* enter spaces above the handle rail 39 by a restoring force of the base portions 53*b* and 54*b*. As described above, by only such an operation that the toner cartridge 31 is fixed and held, so that the toner cartridge 31 is restricted in movement toward the removal direction. In this state, it is possible to regulated a center distance between the driving force transmitting portion 40 and the driving force relay portion 19 (FIG. 6(*a*)) and a center distance between the stirring gear 49 and the gear of the stirring drive mechanism 20 (FIG. 6(*b*)), so that the driving force transmission is performed with reliability.

In such a state that the toner cartridge 31 is only mounted, as shown in FIG. 10(*a*), the handle 36 is located at an initial position, and the handle rail 39 and the projection 54*a* are in such a positional relationship that they are engaged with each other at a position O. The handle lock 38 is not released until immediately before the toner cartridge 31 is completely inserted into the toner supply apparatus, so that this positional relationship is always kept. On the other hand, as shown in FIG. 7(*b*), the toner supply apparatus frame 55 of the apparatus main assembly is provided with a handle lock release rib 55*h* for releasing lock with the handle lock 38. The handle lock release rib 55*h* abuts against the handle lock 38 during the insertion of the toner cartridge 31 as shown in FIG. 3(*b*), so that an end of the handle lock 38 is bent toward the toner container 31*a* (in a direction of an arrow A1). As a result, the handle lock 38 is deviated from the handle lock receiving portion 33 to be released therefrom, so that the handle 36 is placed in a rotationally movable state.

An operation of the handle lock 38 at that time will be described with reference to FIGS. 9(*a*) to 9(*c*), wherein FIGS. 9(*a*) and 9(*b*) are schematic views of the handle lock 38 and the handle lock receiving portion 33 as seen in a direction from below these members, and FIG. 9(*c*) is a schematic view of the neighborhood of the handle lock 38 as seen in the direction of the handle 36. FIG. 9(*a*) shows a state that the handle 36 is locked. As shown in FIG. 9(*b*), when the handle lock release rib 55*h* abuts against the handle lock 38 by the insertion of the toner cartridge 31, the end of the handle lock 38 is deformed toward a direction of an arrow A1 and is capable of entering a spacing between the toner container 31*a* and receiving portions 33*b* and 33*c*. More specifically, as shown in FIG. 9(*c*), the handle lock 38 located at a portion 38-0 at the time of the handle release is moved to a position 38-1 close to the toner container 31*a*, thus permitting rotation of the handle 36. At this time, as shown in FIG. 11(*a*), the engaging boss 45 of the container shutter 32 is engaged with the engaging hole 52*b* of the main assembly shutter 52, so that these shutters are in an integrally operable state.

Further, by this inserting operation, a shutter lock 46 of the container shutter 32 is raised by a shutter lock release projection 55*f* in an upward direction (indicated by an arrow S shown in FIG. 4(*b*)), so that the container shutter 32 is placed in an openable and closable state. Further, as shown in FIG. 11(*a*), a lock release rib 47 (FIG. 4(*b*)) provided to the container shutter 32 presses down on a lock 55*a* of the apparatus shutter 52 in a direction of arrow H to release the lock 55*a*, thus placing also the apparatus shutter 52 in the openable and closable state.

Next, when the grip portion 36*a* is tilted toward a direction of an arrow V as shown in FIG. 10(*b*), the driving force is transmitted from the driving force transmitting portion 40 through the driving force relay portion 19, so that the container shutter 32 and the apparatus shutter 52 start to rotationally move as shown in FIG. 11(*b*). The handle rail 39 is arc-shaped and the projections 53*a* and 54*a* are disposed on a center line of rotational movement of the handle 36, so that the projections 53*a* and 54*a* continue holding the handle rail 39 at a position P (FIG. 10(*b*)). Lower ends of the projections 53*a* and 54*a* are formed in a bend shape, so that they can reduce a contact surface with the handle rail, thus decreasing a resistance during the rotation of the handle. Incidentally, in order to improve operability, it is also possible to provide small rollers at lower ends of the projections 53*a* and 54*a* to further decrease the rotation resistance. When the handle is rotated so that the handle lock 38 located at a position other than the positions of the receiving portions 33*b* and 33*c*, the handle lock 38 is restored from the elastically deformed state to a position 38-2 (FIG. 9(*c*)).

As shown in FIG. 10(*c*), when the grip is fully tilted toward the arrow V direction, the container shutter 32 and the apparatus shutter 52 are placed in a full open state as shown in FIG. 11(*c*) to permit the supply of toner. In this state, the apparatus shutter 52 abuts against the abutting portion 55*g* provided to the toner supply apparatus frame 55 to be restricted in movement, and the handle 36 also reaches its limit of rotational movement. Also in this case, the projections 53*a* and 54*a* continue holding of the handle rail 39 at a position Q. Thereafter, when the cartridge cover 23 is closed, the image forming apparatus main assembly 100 is restored to the recordable (image formable) state. As described above, by such a simple operation that the handle 36 is only rotated, the container shutter 32 and the apparatus shutter 52 are opened to place the image forming apparatus main assembly in the recordable state.

<Operation During Removal of Developer Supply Container>

When toner in the toner container 31*a* is used up and is not supplied from the developer discharge opening 30 to the buffer portion, a toner sensor at the buffer portion detects no toner and a cartridge replacement massage is displayed. The user opens the cartridge cover 23 and performs the replacement of the toner cartridge 31.

More specifically, first, the user rotates the grip portion 36*a* in a direction of an arrow W in order to close the container shutter 32 of the toner cartridge 31 and the apparatus shutter 52. Then, by further rotating the handle 36 as shown in FIG. 10(*d*) so that it exceeds the initial position shown in FIG. 10(*a*), the projection 54*a* reaches a position R corresponding to a terminated portion 39*a* at which the handle rail 39 is terminated. As a result, the engagement of the projections 53*a* and 54*a* with the handle rail 39 is released, so that removal of the toner cartridge 31 becomes possible. Accordingly, in the case where the toner is emptied, the shutters are closed by such a simple operation that the handle 36 is only rotated to place the toner cartridge 31 in a removal state.

Here, an amount of rotational movement of the handle 36 will be described with reference to FIG. 12.

Referring to FIG. 12, an uppermost bar line represents whether the toner cartridge 31 is removable or unremoved, and second bar line represents the amount of handle rotational movement during the open of the shutters. Symbols O, P and Q correspond to those representing the positional relationships between the handle 36 and the projection 54*a* shown in FIGS. 10(*a*), 10(*b*) and 10(*c*). When the shutters are opened, the handle 36 is rotationally moved by B.

A third bar line represents the amount of handle rotational movement during the close of the shutters. As described above, the driving force is not transmitted in an amount corresponding to backlash of the gear when the handle 36 starts to be moved, so that only the handle 36 is moved in an amount C. Further, the handle 36 is rotated in the amount B but the toner cartridge 31 cannot be removed since the projection 54*a* is engaged with the handle rail 39. Then, when the handle 36 is further rotated in an amount D, the terminated portion 39*a* (position R) comes immediately under the projection 54*a*, so that it is possible to remove the toner cartridge 31.

The amount of handle rotational movement (Q to R) in the shutter close direction is larger than the amount of handle rotational movement in the shutter open direction (O to Q). However, by setting a length of the handle rail corresponding to the amount (O to R) so that it is not less than that corresponding to backlash loss, it is possible to realize such a state that the toner cartridge 31 can be removed only after the container shutter 32 and the apparatus shutter 52 are returned to their original positions.

Further, as shown in FIG. 9(*c*), at the upper surface of the upper receiving portion 33*b* of the handle lock receiving portion 33 is provided with an inclined surface, so that the handle lock 38 is naturally deformed along the inclined surface to enter a spacing 33*a* during the closer of the handle 36. Incidentally, the spacing 33*a* is also provided between the lower receiving portion 33*c* and the toner container 31*a*, so that the handle 36 can be further rotated when compared with the case of the initial position.

The handle 36 is, after the projections 53*a* and 54*a* reach the terminated portion 39*a*, stopped at such a further moved position at which an upper surface of the container grip 35 and a lower surface of the grip portion 36*a* run against each other. At this time, the main assembly shutter lock 55*a* elastically restored to the original position to lock the apparatus shutter 52. By the above described constitution, it is possible to ensure that the shutters are closed when the user removes the toner cartridge 31 from the image forming apparatus main assembly. By adopting such a constitution that the toner cartridge 31 cannot be taken out until the shutters are completely closed, it is possible to prevent toner scattering from the toner container and accumulation of deviation of the shutters due to repetitive mounting and demounting of the toner cartridge.

Further, when the toner cartridge 31 is taken out, the shutter lock 46 is not supplied with a pressing force from the shutter lock release projection 55*f* on the toner cartridge 31 side, so that the shutter lock 46 is elastically restored to the original position to be engaged with the shutter lock receiving portion 28. As a result, it is possible to prevent the container shutter 32 from being accidentally opened, so that there is no worry that the toner in the container is scattered out, and handling of the toner cartridge outside the main assembly becomes easy.

Further, at a lower portion below a center of the rotational movement of the handle 36, an abutting portion 41 as an example of a container-side return means is provided (FIG. 4(*a*)). On the other hand, a return abutting portion 55*c* as an example of a main assembly-side return means is provided on the main assembly side as shown in FIG. 7(*a*). The abutting portion 41 abuts against the return abutting portion 55*c* when the toner cartridge 31 is taken out of the main assembly, so that the handle 36 is rotationally moved to restore its phase to the initial position. In this state, the handle lock 38 is elastically restored to the original position and enters the spacing (the position 38-0 in FIG. 9(*c*)) between the upper and lower receiving portions 33*b* and 33*c* to be fixed. Accordingly, even when the same toner cartridge 31 is inserted again, the handle operation can be performed always under the same condition. Further, in such a state that the toner cartridge 31 is outside the main assembly, the handle 36 is always locked, so that it is possible to further improve the operability.

INDUSTRIAL APPLICABILITY

As described hereinabove, according to the present invention, in the image forming apparatus to which the developer supply container is inserted and removed therefrom in a direction perpendicular to the rotation axis of the drive mechanism, it is possible to return the main assembly shutter and the container shutter to their initial positions with reliability during the removal of the developer supply container and to simply hold the developer supply container so as to transmit the driving force with reliability during the mounting of the developer supply container.

Further, by employing such a constitution that the developer supply container is mounted and demounted in the vertical direction, it is not necessary to ensure a space for mounting and demounting the developer supply container at a side surface of the apparatus main assembly. As a result, the image forming apparatus can be mounted in a state close to a wall surface of a room to permit effective utilization of a mounting space of the apparatus main assembly. Particularly, a single function printer has no image reading portion, so that an opening and closing operation can easily be performed even when an opening and closing portion is provided on the apparatus main assembly. As a result, it is not necessary to access a side surface of the printer main assembly, so that it is possible to perform a replacement operation of the developer supply container from a front surface side where an operation portion is provided. Thus, an operability can be improved.

While the invention has been described with reference to the structures disclosed herein, it is not confined to the details set forth and this application is intended to cover such modifications or changes as may come within the purpose of the improvements or the scope of the following claims.

The invention claimed is:

1. A developer supply container detachably mountable to an electrophotographic image forming apparatus, the apparatus including an apparatus shutter configured to open and close a developer receiving opening and a gear, said container comprising:

a container body including an inner space configured to contain developer and a developer discharging opening configured to permit discharge of the developer in said container body toward the developer receiving opening; and a manual operating member configured and positioned to rotate with respect to said container body in two rotational directions to open and close the apparatus shutter, said manual operating member including:

a gear portion engageable with the gear during a mounting operation of said container to the apparatus, to transmit a drive force in one rotational direction to the apparatus shutter through the gear so as to open the apparatus shutter, and to transmit a drive force in the other rotational direction to the apparatus shutter through the gear so as to close the apparatus shutter; and a locking portion configured and positioned to be locked with the apparatus during the mounting operation of said container to prevent a demounting of said container from the apparatus, wherein said manual operating member is rotatable between a first angular position in which said locking portion is locked with the apparatus during the mounting operation of said container, a second angular position offset from the first angular position in the one rotational direction in which the apparatus shutter is opened, and a third angular position offset from the first angular position in the other rotational direction in which said locking portion is released from the apparatus with a closing operation of the apparatus shutter.

2. A container according to claim 1, further comprising a container shutter configured and positioned to open and close said developer discharging opening, wherein said container shutter includes a shutter gear portion configured and positioned to receive the drive forces from said gear portion of said manual operating member through the gear, and an engaging portion configured and positioned to engage with the apparatus shutter during the mounting operation of said container so that opening and closing operations of said container shutter and opening and closing operations of the apparatus shutter are interrelated with each other by the drive forces.

3. A container according to claim 1, wherein said manual operating member further includes a regulating portion configured and positioned to regulate a manual rotation of said manual operating member with respect to said container body, and wherein said regulating portion is released from said container body during the mounting operation of said container so that the manual rotation of said manual operating member is permitted.

4. A container according to claim 1, wherein said container is detachably mountable to the apparatus in a direction substantially perpendicular to a rotational axial direction of said manual operating member.

5. A container according to claim 1, wherein said manual operating member further includes an abutment portion configured and positioned to abut against the apparatus to rotate said manual operating member from the third angular position to the first angular position in the one rotational direction.

6. A developer supply container detachably mountable to an electrophotographic image forming apparatus, the apparatus including an apparatus shutter configured to open and close a developer receiving opening, a first gear, and a second gear drive-connected with the first gear, said container comprising:

a container body including an inner space configured to contain developer and a developer discharging opening configured to permit discharge of the developer in said container body toward the developer receiving opening;

a container shutter configured and positioned to open and close said developer discharging opening, said container shutter including:

a shutter gear portion engageable with the first gear; and an engaging portion configured and positioned to engage with the apparatus shutter during a mounting operation of said container to the apparatus so that opening and closing operations of said container shutter and opening and closing operations of the apparatus shutter are interrelated with each other; and a manual operating member configured and positioned to rotate with respect to said container body in two rotational directions to open and close said container shutter, said manual operating member including:

a regulating portion configured and positioned to regulate a manual rotation of said manual operating member with respect to said container body, said regulating portion being released from said container body during the mounting operation of said container so that the manual rotation of said manual operating member is permitted;

a gear portion engageable with the second gear during a mounting operation of said container to the apparatus to transmit a drive force in one rotational direction to said container shutter through the second gear so as to open said container shutter, and to transmit a drive force in the other rotational direction to said container shutter through the second gear so as to close said container shutter; and a locking portion configured and positioned to be locked with the apparatus during the mounting operation of said container to prevent a demounting of said container from the apparatus, wherein said manual operating member is rotatable between a first angular position in which said locking portion is locked with the apparatus during the mounting operation of said container, a second angular position offset from the first angular position in the one rotational direction in which said container shutter is opened, and a third angular position offset from the first angular position in the other rotational direction in which said locking portion is released from the apparatus with a closing operation of said container shutter.

7. A developer supply system in an electrophotographic image forming apparatus comprising:

an apparatus shutter configured to open and close a developer receiving opening;

a gear; and a developer supply container detachably mountable to the apparatus, said container including:

a container body including an inner space configured to contain developer and a developer discharging opening configured to permit discharge of the developer in said container body toward said developer receiving opening; and a manual operating member configured and positioned to rotate with respect to said container body in two rotational directions to open and close said apparatus shutter; said manual operating member including:

a gear portion engageable with said gear during a mounting operation of said container to the apparatus, to transmit a drive force in one rotational direction to said apparatus shutter through said gear so as to open said apparatus shutter, and to transmit a drive force in the other rotational direction to said apparatus shutter through said gear so as to close said apparatus shutter; and a locking portion configured and positioned to be locked with the apparatus during the mounting operation of said container to prevent a demounting of said container from the apparatus, wherein said manual operating member is rotatable between a first angular position in which said locking portion is locked with the apparatus during the mounting operation of said container, a second angular position offset from the first angular position in the one rotational direction in which said apparatus shutter is opened, and a third angular position offset from the first angular position in the other rotational direction in which said locking portion is released from the apparatus with a closing operation of said apparatus shutter.

8. A system according to claim 7, further comprising a container shutter configured and positioned to open and close said developer discharging opening, wherein said container shutter includes a shutter gear portion configured and positioned to receive the drive forces from said gear portion of said manual operating member through said gear, and an engaging portion configured and positioned to engage said apparatus shutter during the mounting operation of said container so that opening and closing operations of said container shutter and opening and closing operations of said apparatus shutter are interrelated with each other by the drive forces.

9. A system according to claim 7, wherein said manual operating member further includes a regulating portion configured and positioned to regulate a manual rotation of said manual operating member with respect to said container body, and wherein said regulating portion is released from said container body during the mounting operation of said container so that the manual rotation of said manual operating member is permitted.

10. A system according to claim 7, wherein said container is detachably mountable to the apparatus in a direction substantially perpendicular to a rotational axial direction of said manual operating member.

11. A system according to claim 7, wherein said manual operating member further includes an abutment portion configured and positioned to abut against the apparatus to rotate said manual operating member from the third angular position to the first angular position in the one rotational direction.

12. A developer supply system in an electrophotographic image forming apparatus comprising:

an apparatus shutter configured to open and close a developer receiving opening;

a first gear;

a second gear drive-connected with said first gear; and a developer supply container detachably mountable to the apparatus, said container including:

a container body including an inner space configured to contain developer and a developer discharging opening configured to permit discharge of the developer in said container body toward said developer receiving opening;

a container shutter configured and positioned to open and close said developer discharging opening, said container shutter including:

a shutter gear portion engageable with said first gear; and an engaging portion configured and positioned to engage with said apparatus shutter during a mounting operation of said container to the apparatus so that opening and closing operations of said container shutter and opening and closing operations of said apparatus shutter are interrelated with each other;

a manual operating member configured and positioned to rotate with respect to said container body in two rotational directions to open and close said container shutter, said manual operating member including:

a regulating portion configured and positioned to regulate a manual rotation of said manual operating member with respect to said container body, said regulating portion being released from said container body during the mounting operation of said container so that the manual rotation of said manual operating member is permitted;

a gear portion engageable with said second gear during a mounting operation of said container into the apparatus, to transmit a drive force in one rotational direction to said container shutter through said second gear so as to open said container shutter, and to transmit a drive force in the other rotational direction to said container shutter through said second gear so as to close said container shutter; and a locking portion configured and positioned to be locked with the apparatus during the mounting operation of said container to prevent a demounting of said container from the apparatus, wherein said manual operating member is rotatable between a first angular position in which said locking portion is locked with the apparatus during the mounting operation of said container, a second angular position offset from the first angular position in the one rotational direction in which said container shutter is opened, and a third angular position offset from the first angular position in the other rotational direction in which said locking portion is released from the apparatus with a closing operation of said container shutter.

* * * * *